US011674102B2

(12) United States Patent
Haramoto et al.

(10) Patent No.: US 11,674,102 B2
(45) Date of Patent: Jun. 13, 2023

(54) ELECTRICALLY-CONDUCTIVE LUBRICANT

(71) Applicants: UNIVERSITY OF YAMANASHI, Yamanashi (JP); NIPPON THOMPSON CO., LTD., Tokyo (JP); Ushio Chemix Corporation, Shizuoka (JP)

(72) Inventors: Yuichiro Haramoto, Yamanashi (JP); Shigemasa Itabashi, Kanagawa (JP); Ayana Takemura, Kanagawa (JP); Kazuo Okamoto, Shizuoka (JP); Hiroyuki Otsuki, Shizuoka (JP)

(73) Assignees: UNIVERSITY OF YAMANASHI, Yamanashi (JP); NIPPON THOMPSON CO., LTD., Tokyo (JP); Ushio Chemix Corporation, Shizuoka (JP)

( * ) Notice: Subject to any disclaimer, the term of this patent is extended or adjusted under 35 U.S.C. 154(b) by 0 days.

(21) Appl. No.: 17/752,552

(22) Filed: May 24, 2022

(65) Prior Publication Data

US 2022/0372387 A1 Nov. 24, 2022

Related U.S. Application Data

(63) Continuation of application No. 17/261,302, filed as application No. PCT/JP2019/027966 on Jul. 16, 2019, now Pat. No. 11,447,711.

(30) Foreign Application Priority Data

Jul. 17, 2018 (JP) ..... JP2018-133840
Aug. 23, 2018 (JP) ..... JP2018-156580
Aug. 23, 2018 (JP) ..... JP2018-156581

(51) Int. Cl.
*C10M 105/18* (2006.01)
*C10N 30/00* (2006.01)
(Continued)

(52) U.S. Cl.
CPC .. *C10M 105/18* (2013.01); *C10M 2207/0406* (2013.01); *C10N 2020/079* (2020.05);
(Continued)

(58) Field of Classification Search
CPC ..... C10M 105/18; C10M 2207/0406; C10N 2020/079; C10N 2030/30; C10N 2030/40; C10N 2040/02; C10N 2040/18
See application file for complete search history.

(56) References Cited

U.S. PATENT DOCUMENTS

2013/0005630 A1 1/2013 Kuratomi et al.
2013/0096042 A1 4/2013 Oda

FOREIGN PATENT DOCUMENTS

JP H06128582 A 5/1994
JP 2004359848 A 12/2004
(Continued)

OTHER PUBLICATIONS

International Search Report issued in corresponding International Application No. PCT/JP2019/027966; dated Sep. 10, 2019 (2 pages).
(Continued)

*Primary Examiner* — James C Goloboy
(74) *Attorney, Agent, or Firm* — Osha Bergman Watanabe & Burton LLP

(57) ABSTRACT

Provided is a lubricant composition including a bicyclic liquid crystal of formula (1), and a tricyclic liquid crystal compound of formula (2), and having a mixing mass ratio of the bicyclic liquid crystal compound and tricyclic liquid crystal compound of 95:5 to 15:85. The composition is suitable for use in a clean environment, under a high vacuum, under high temperature and a bearing.

Formula (1)

(1)

$R^1$ and $R^2$ are the same or different from each other, and each is —$OCH_2CH_2CH(R')CH_2CH_2OR$
(Continued)

Formula (2)

(2)

$R^{11}$ and $R^{21}$ are the same or different from each other, and each is —OR. $R^{12}$, $R^{13}$, $R^{22}$ and $R^{23}$ are the same or different from each other, and each is hydrogen or —OR. R is a linear or branched $C_nH_{2n+1}$, $1 \leq n \leq 20$ and R' is methyl or ethyl.

6 Claims, 10 Drawing Sheets

(51) Int. Cl.

| | |
|---|---|
| ***C10N 20/00*** | (2006.01) |
| ***C10N 40/02*** | (2006.01) |
| ***C10N 40/18*** | (2006.01) |

(52) U.S. Cl.
CPC ..... *C10N 2030/30* (2020.05); *C10N 2030/40* (2020.05); *C10N 2040/02* (2013.01); *C10N 2040/18* (2013.01)

(56) References Cited

FOREIGN PATENT DOCUMENTS

| | | | | |
|---|---|---|---|---|
| JP | 2005139398 | A | | 6/2005 |
| JP | 2008214603 | A | | 9/2008 |
| JP | 2013082900 | A | | 5/2013 |
| JP | 2017105874 | A | * | 6/2017 |
| JP | 2017105874 | A | | 6/2017 |
| JP | 2019112495 | A | | 7/2019 |
| WO | 2011125842 | A1 | | 10/2011 |
| WO | 2019124072 | A1 | | 6/2019 |

OTHER PUBLICATIONS

Written Opinion of the International Searching Authority issued in corresponding International Application No. PCT/JP2019/027966; dated Sep. 10, 2019 (6 pages).

* cited by examiner (A)

(B)

ELECTRICALLY-CONDUCTIVE LUBRICANT

TECHNICAL FIELD

The present invention relates to an electrically-conductive lubricant.

BACKGROUND ART

Lubricants are substances that are generally applied to moving parts of machines to reduce friction between parts which come into contact with each other, prevent generation of frictional heat, prevent stress from concentrating on the contacted portions between parts, and also play a role of sealing, rust prevention, dust prevention, and the like. In the lubricants, lubricating oils and greases are contained, and whereas the lubricating oils are generally mixed oils such as refined petroleum products, and the like, the greases are materials in which the lubricating oils are retained to a thickener to provide it thixotropic properties for the purpose of applying it to sliding surfaces (for example, plain bearings and rolling bearings) which are difficult to keep with a lubricant film.

For such a lubricant, various characteristics are required to, needless to say, exhibit a low friction coefficient, have a wide usable temperature range, low loss due to evaporation, decomposition, etc., over a long period of time, and the like. In addition, it is advantageous that the lubricant has conductivity so that static electricity generated between parts due to rotational friction can be released, and if a lubricant having conductivity can be obtained even if carbon or metal powder, etc., is not mixed, it would be extremely useful.

In Patent Documents 1 and 2, a diester type lubricating oil compound having ester structures at both ends of the molecule has been disclosed. Also, in Patent Documents 3 to 6, it has been proposed to use a liquid crystal compound as a lubricant. In Patent Document 7, a lubricant containing a liquid crystal compound having conductivity is described, but it cannot be said that the compound exhibits liquid crystallinity at room temperature.

PRIOR ART DOCUMENTS

Patent Documents

Patent Document 1: JPWO2011/125842A1
Patent Document 2: JP 2013-82900A
Patent Document 3: JP Hei. 6-128582A
Patent Document 4: JP 2004-359848A
Patent Document 5: JP 2005-139398A
Patent Document 6: JP 2008-214603A
Patent Document 7: JP 2017-105874A

SUMMARY OF INVENTION

Problems to be Solved by the Invention

However, as a lubricant that replaces conventional grease, improvement was insufficient in the characteristics such as lubricity (low friction coefficient), heat resistance, durability with a little evaporation amount over a long period of time, conductivity that can release static electricity generated between parts due to rotational friction, clean appearance due to absence of carbon or metal powder, etc.

Thus, the present invention is to provide a lubricant which has conductivity without formulating carbon or metal powder, etc., is effective in a wide temperature range, and, has a little loss due to evaporation, decomposition, etc., for a long period of time.

Specifically, with regard to heat resistance, it is desirable to be stable at a temperature of 140° C. or higher, preferably 200° C. or higher, more preferably 230° C. or higher, further preferably 250° C. or higher, and most preferably 300° C. or higher. On the other hand, as a low temperature characteristic, it is desirable that it can be used at 30° C. or lower, preferably about −50° C. Also, with regard to conductivity, it is necessary that at least the static electricity generated between the parts due to the rotational friction can be released and, for example, it is desirable to have conductivity of 0.001 μA or more, more preferably 0.01 μA or more, and further preferably 0.07 μA or more in the range of 30° C. to 300° C. when the material is injected into a cell having an electrode area of 1 $cm^2$ and a distance between electrodes of 5 μm, and a voltage of 5V is applied between the electrodes.

Further, since it is not necessary to add carbon or metal to impart conductivity, there are advantages that it satisfies economic rationality and, at the time of starting use, it exhibits clean appearance, it can find at an early stage when oxidative deterioration (yellowing) occurs. Moreover, since the compound itself is a fluorescent substance, for example, there is an advantage that defects such as lubricant leakage can be immediately detected by irradiating light from a black light which is an electric lamp that emits long-wavelength ultraviolet rays. Needless to say, it is necessary to satisfy the original lubrication performance, and it is desirable to have a dynamic friction coefficient of 0.13 or less.

And yet, it is desirable to accomplish the above-mentioned characteristics not using lubricating liquid crystal compounds by mixing many kinds, but by mixing as few as possible, preferably one kind or two kinds, ultimately one kind of the liquid crystal compound. For accomplishing this object, it is important to appropriately design the chemical structure of the compound which exhibits liquid crystallinity in a wide temperature range.

Also, when used in an environment where it is extremely difficult to replace the lubricant, such as in wind power generation, polar regions, and space-related applications, a lubricant having little loss due to evaporation, decomposition, etc., for a long period of time is extremely useful.

Means to Solve the Problems

The present inventor has earnestly studied to solve the above-mentioned problems, and as a result, they have found that a compound in which a specific aromatic ring structure responsible for conductivity and a specific chain group linked to the ring structure and responsible for lubricity are appropriately arranged in one molecule can accomplish the above-mentioned objects, whereby the present invention has completed.

That is, the present invention includes the following.

[1] An electrically-conductive lubricant comprises at least one kind of a compound represented by the formula (1):

[Formula 1]

(1)

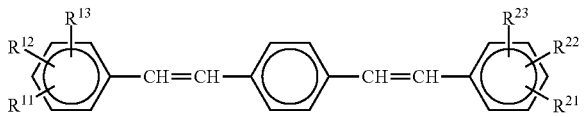

[wherein, $R^{11}$ and $R^{21}$ are the same or different from each other, and each is hydrogen, a group —OR or a group —$OCH_2CH_2CH(R')CH_2CH_2OR$ (R is a linear or branched $C_nH_{2n+1}$, $4 \leq n \leq 12$, and R' is methyl or ethyl), $R^{12}$, $R^{13}$, $R^{22}$ and $R^{23}$ are the same or different from each other, and each is a group —OR or a group —$OCH_2CH_2CH(R')CH_2CH_2OR$ (R is a linear or branched $C_nH_{2n+1}$, $4 \leq n \leq 12$, and R' is methyl or ethyl)].

[2] The electrically-conductive lubricant described in [1], which comprises at least one kind of the compound represented by the formula (1) where $R^{11}$, $R^{12}$, $R^{13}$, $R^{21}$, $R^{22}$ and $R^{23}$ are the same or different from each other, and each is a group —OR (R is a linear or branched $C_nH_{2n+1}$, and $4 \leq n \leq 12$).

[3] The electrically-conductive lubricant described in [2], which comprises at least one kind of the compound represented by the formula (1) where $R^{11}$, $R^{12}$ and $R^{13}$ are substituted to a para-position and two positions of meta-positions relative to the —CH═CH— group, and $R^{21}$, $R^{22}$ and $R^{23}$ are substituted to a para-position and two positions of meta-positions relative to the —CH═CH— group.

[4] The electrically-conductive lubricant described in [1], which comprises at least one kind of the compound represented by the formula (1) where $R^{11}$ and $R^{21}$ are hydrogens, and $R^{12}$, $R^{13}$, $R^{22}$ and $R^{23}$ are the same or different from each other, and each is a group —$OCH_2CH_2CH(R')CH_2CH_2OR$ (R is a linear or branched $C_nH_{2n+1}$, $4 \leq n \leq 12$, and R' is methyl or ethyl).

[5] The electrically-conductive lubricant described in [4], which comprises two or more kinds of the compound (1) represented by the formula (1) where $R^{12}$ and $R^{13}$ are substituted to the para-position and one position of the meta-position relative to the —CH═CH— group, and $R^{22}$ and $R^{23}$ are substituted to the para-position and one position of the meta-position relative to the —CH═CH— group.

[6] The electrically-conductive lubricant described in any one of [1] to [5], wherein the groups bonded to —CH═CH— in the formula (1) have positional relationship of trans.

[7] The electrically-conductive lubricant described in [1], wherein the compound (1) represented by the formula (1) exhibits a smectic liquid crystal phase in a temperature range of −50° C. to +300° C.

[8] The electrically-conductive lubricant described in any one of [1] to [7], wherein the lubricant exhibits conductivity of 0.07 μA or more in a temperature range of 30° C. to 300° C. when it is injected into a cell having an electrode area of 1 $cm^2$ and a distance between electrodes of 5 μm, and a voltage of 5V is applied between the electrodes.

[9] The electrically-conductive lubricant described in [2] or [3], wherein the lubricant exhibits conductivity of 10,000 μA or more in a temperature range of 30° C. to 90° C. when it is injected into a cell having an electrode area of 1 $cm^2$ and a distance between electrodes of 5 μm, and a voltage of 5V is applied between the electrodes.

[10] The electrically-conductive lubricant described in any one of [1] to [9], which does not contain either of carbon or metal.

[11] The electrically-conductive lubricant described in any one of [1] to [10], wherein the compound (1) represented by the formula (1) is a fluorescent substance.

[12] The electrically-conductive lubricant described in any one of [1] to [11], wherein the compound (1) represented by the formula (1) is a trans-isomer represented by the formula (1'):

[Formula 2]

(1')

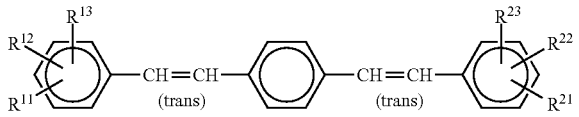

[wherein, $R^{11}$, $R^{12}$, $R^{13}$, $R^{21}$, $R^{22}$ and $R^{23}$ have the same meanings as those of $R^{11}$, $R^{12}$, $R^{13}$, $R^{21}$, $R^{22}$ and $R^{23}$ in the formula (1)].

[13] Use of the compound represented by the formula (1):

[Formula 3]

(1)

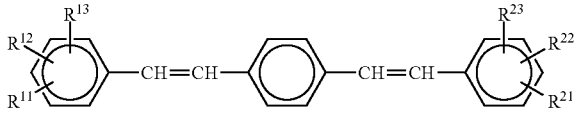

[wherein, $R^{11}$ and $R^{21}$ are the same or different from each other, and each is hydrogen, a group —OR or a group —$OCH_2CH_2CH(R')CH_2CH_2OR$ (R is a linear or branched $C_nH_{2n+1}$, $4 \leq n \leq 12$, and R' is methyl or ethyl), and $R^{12}$, $R^{13}$, $R^{22}$ and $R^{23}$ are the same or different from each other, and each is a group —OR or a group —$OCH_2CH_2CH(R')CH_2CH_2OR$ (R is a linear or branched $C_nH_{2n+1}$, $4 \leq n \leq 12$, and R' is methyl or ethyl)]

for the manufacture of an electrically-conductive lubricant.

[14] A mechanical apparatus which comprises a plurality of mechanical elements that come into contact with each other and move relative to each other, and the electrically-conductive lubricant described in any one of [1] to [12] that is arranged on at least a part of the contact surface of the mechanical elements.

Effects of the Invention

According to the present invention, it is provided a novel lubricant which exhibits a low friction coefficient, is excellent in heat resistance, has a lubricating effect in a wide temperature range (at least −50° C. to +300° C.), has a little loss over a long period of time, exhibits conductivity without mixing with carbon powder or metal powder, etc., emits fluorescence by irradiation of ultraviolet rays, and can replace conventional grease without using a thickener.

EMBODIMENTS TO CARRY OUT THE INVENTION

Figure 1:
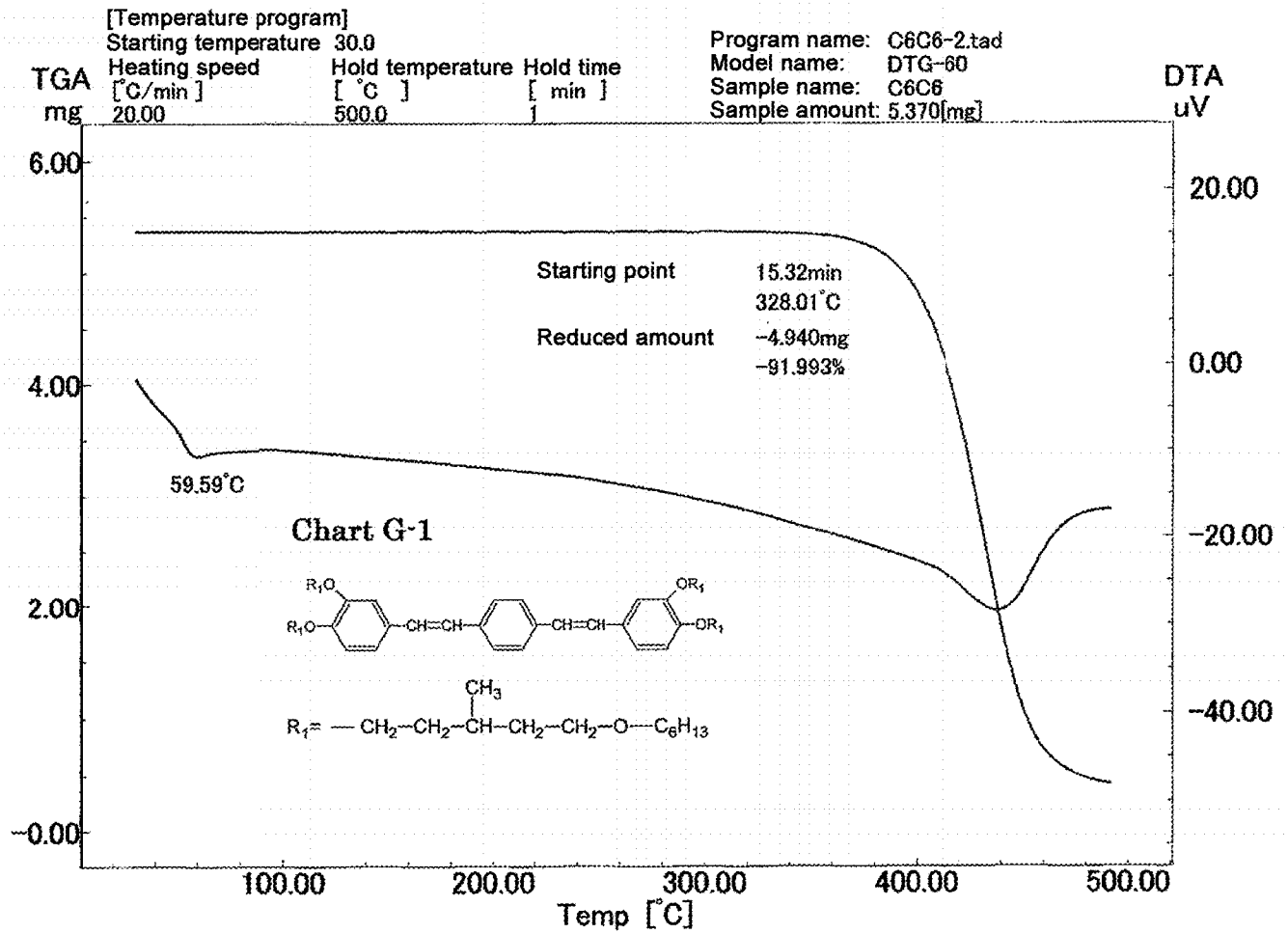
FIG. 1 is differential thermal analysis data of a compound for an electrically-conductive lubricant according to the present invention.

According to the present invention, it is provided an electrically-conductive lubricant comprising at least one kind of a compound (1) represented by the formula (1):

[Formula 4]

(1)

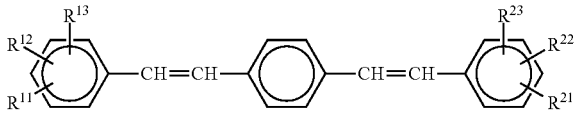

[wherein, $R^{11}$ and $R^{21}$ are the same or different from each other, and each is hydrogen, a group —OR or a group —$OCH_2CH_2CH(R')CH_2CH_2OR$ (R is a linear or branched $C_nH_{2n+1}$, $4 \leq n \leq 12$, and R' is methyl or ethyl), $R^{12}$, $R^{13}$, $R^{22}$ and $R^{23}$ are the same or different from each other, and each is a group —OR or a group —$OCH_2CH_2CH(R')CH_2CH_2OR$ (R is a linear or branched $C_nH_{2n+1}$, $4 \leq n \leq 12$, and R' is methyl or ethyl)].

The compound (1) represented by the formula (1) is a compound in which a specific π electron conjugated core structure (1,4-bis[phenyl)ethenyl]benzene, hereinafter sometimes refers to as "3-ring skeletal structure") responsible for conductivity, and a specific chain group linked with the core structure and responsible for lubricity are appropriately arranged in one molecule.

In the formula (1), the 3-ring skeletal structure contains conjugated systems of 22 π electrons, takes a rigid flat plate structure since the π-electron conjugated systems are spread, and therefore, each molecule of the compound (1) thinly overlaps and gathers so as to overlap the π-electron conjugated systems with each other. As a result, the compound (1) can form a liquid crystal phase (in particular, smectic liquid crystal phase) in a desired temperature range (specifically shown in Examples mentioned later). Thus, the 3-ring skeletal structure becomes a liquid crystal forming element (core structure) in the compound (1), and the compound (1) exhibits conductivity through the overlapped π-electron conjugated systems.

[Chain groups $R^{11}$, $R^{12}$, $R^{13}$, $R^{21}$, $R^{22}$ and $R^{23}$]

In the formula (1), $R^{11}$, $R^{12}$, $R^{13}$, $R^{21}$, $R^{22}$ and $R^{23}$ are chain groups that are linked to the core structure and responsible for lubricity of the molecule.

$R^{11}$ and $R^{21}$ are the same or different from each other, and each is hydrogen, a group —OR or a group —$OCH_2CH_2CH(R')CH_2CH_2OR$ (R is a linear or branched $C_nH_{2n+1}$, $4 \leq n \leq 12$, preferably $6 \leq n \leq 10$, and R' is methyl or ethyl, and preferably methyl), $R^{12}$, $R^{13}$, $R^{22}$ and $R^{23}$ are the same or different from each other, and each is a group —OR or a group —$OCH_2CH_2CH(R')CH_2CH_2OR$ (R is a linear or branched $C_nH_{2n+1}$, $4 \leq n \leq 12$, preferably $6 \leq n \leq 10$, and R' is methyl or ethyl, and preferably methyl).

Examples of R are an n-butyl group, an isobutyl group, a sec-butyl group, a tert-butyl group, an n-pentyl group, a 1-methyl-n-butyl group, a 2-methyl-n-butyl group, a 3-methyl-n-butyl group, a 1,1-dimethyl-n-propyl group, a 1,2-dimethyl-n-propyl group, a 2,2-dimethyl-n-propyl group, a 1-ethyl-n-propyl group, an n-hexyl group, a 1-methyl-n-pentyl group, a 2-methyl-n-pentyl group, a 3-methyl-n-pentyl group, a 4-methyl-n-pentyl group, a 1,1-dimethyl-n-butyl group, a 1,2-dimethyl-n-butyl group, a 1,3-dimethyl-n-butyl group, a 2,2-dimethyl-n-butyl group, a 2,3-dimethyl-n-butyl group, a 3,3-dimethyl-n-butyl group, a 1-ethyl-n-butyl group, a 2-ethyl-n-butyl group, a 1,1,2-trimethyl-n-propyl group, a 1,2,2-trimethyl-n-propyl group, a 1-ethyl-1-methyl-n-propyl group, a 1-ethyl-2-methyl-n-propyl group, an n-heptyl group, a 1-methyl-n-hexyl group, a 2-methyl-n-hexyl group, a 3-methyl-n-hexyl group, a 1,1-dimethyl-n-pentyl group, a 1,2-dimethyl-n-pentyl group, a 1,3-dimethyl-n-pentyl group, a 2,2-dimethyl-n-pentyl group, a 2,3-dimethyl-n-pentyl group, a 3,3-dimethyl-n-pentyl group, a 1-ethyl-n-pentyl group, a 2-ethyl-n-pentyl group, a 3-ethyl-n-pentyl group, a 1-methyl-1-ethyl-n-butyl group, a 1-methyl-2-ethyl-n-butyl group, a 1-ethyl-2-methyl-n-butyl group, a 2-methyl-2-ethyl-n-butyl group, a 2-ethyl-3-methyl-n-butyl group, an n-octyl group, a 1-methyl-n-heptyl group, a 2-methyl-n-heptyl group, a 3-methyl-n-heptyl group, a 1,1-dimethyl-n-hexyl group, a 1,2-dimethyl-n-hexyl group, a 1,3-dimethyl-n-hexyl group, a 2,2-dimethyl-n-hexyl group, a 2,3-dimethyl-n-hexyl group, a 3,3-dimethyl-n-hexyl group, a 1-ethyl-n-hexyl group, a 2-ethyl-n-hexyl group, a 3-ethyl-n-hexyl group, a 1-methyl-1-ethyl-n-pentyl group, a 1-methyl-2-ethyl-n-pentyl group, a 1-methyl-3-ethyl-n-pentyl group, a 2-methyl-2-ethyl-n-pentyl group, a 2-methyl-3-ethyl-n-pentyl group, a 3-methyl-3-ethyl-n-pentyl group, an n-nonyl group, an n-decyl group, an n-undecyl group, an n-dodecyl group and the like.

Although R may be a branched chain, it is desirable to keep the bulkiness to the extent that it prevents tight gathering of molecules of the compound (1) and does not impair the function of the 3-ring skeletal structure as mentioned above, that is, the function of exhibiting conductivity through the overlapped i-electron conjugated systems.

By appropriately selecting the chain groups $R^{11}$, $R^{12}$, $R^{13}$, $R^{21}$, $R^{22}$ and $R^{23}$, the size (long axis) and polarity of the whole molecule can be adjusted. In the following, particularly preferable selection will be explained.

[Compound Wherein $R^{11}$ and $R^{21}$ are Hydrogens, and $R^{12}$, $R^{13}$, $R^{22}$ and $R^{23}$ are Each Group —$OCH_2CH_2CH(R')CH_2CH_2OR$]

When $R^{11}$ and $R^{21}$ are hydrogens, the total number of the substituents on the benzene ring existing at both ends of the 3-ring skeletal structure is four. In the following, such a compound is sometimes referred to as "4-substituted compound".

It is possible to arrange the four substituents ($R^{12}$, $R^{13}$, $R^{22}$ and $R^{23}$) which are not hydrogen as asymmetrically such as three on the benzene ring at one end of the 3-ring skeletal structure, and one on the benzene ring at the other end, but for convenience of synthesis, etc., it is convenient to symmetrically arrange two on the benzene ring at one end of the 3-ring skeletal structure, and two on the benzene ring at the other end.

In such a case, there are substitution positions of 2,3-, 2,4-, 2,5-, 2,6-, 3,4- and 3,5- of each benzene ring, and substitution of 3,4-positions is preferable.

In the 4-substituted compound having substituents at the 3,4-positions of each benzene ring, the following stereoisomers exist, and in the present invention, either one of which may be used or a mixture of both may be used.

[Formula 5]

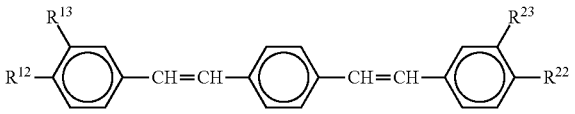

[Formula 6]

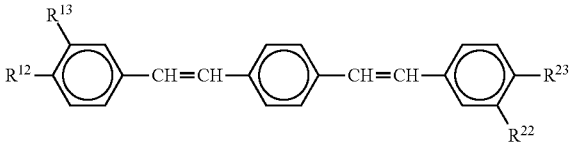

[Compound Wherein $R^{11}$, $R^{12}$, $R^{13}$, $R^{21}$, $R^{22}$ and $R^{23}$ are Each Group —OR]

When $R^{11}$, $R^{12}$, $R^{13}$, $R^{21}$, $R^{22}$ and are groups —OR, the total number of the substituents on the benzene ring at both ends of the 3-ring skeletal structure is six. In the following, such a compound is sometimes referred to as "6-substituted compound".

It is possible to arrange the six substituents ($R^{11}$, $R^{12}$, $R^{13}$, $R^{21}$, $R^{22}$ and $R^{23}$) as asymmetrically such as four on the benzene ring at one end of the 3-ring skeletal structure, and two on the benzene ring at the other end, but for convenience of synthesis, etc., it is convenient to symmetrically arrange three on the benzene ring at one end of the 3-ring skeletal structure, and three on the benzene ring at the other end.

In such a case, there are substitution positions of 2,3,4-, 2,3,5-, 2,4,5-, 3,4,5-, 2,3,6- and 2,4,6- of each benzene ring, and substitution of 3,4,5-positions is preferable as follows.

[Formula 7]

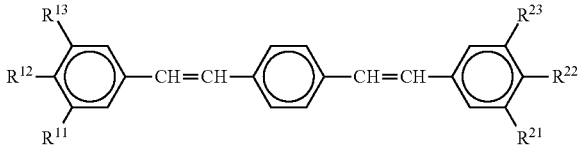

In the present invention, the compound (1) represented by the formula (1) may be used alone or in combination of two or more kinds. For example, there may be an embodiment in which two or more kinds of 4-substituted compounds are mixed and used, an embodiment in which one or more kinds of 4-substituted compounds and one or more kinds of 6-substituted compounds are mixed and used, an embodiment in which a 4-substituted compound or a 6-substituted compound is each used alone, and the like.

[Synthesis of Compound]

A method for producing the compound (1) represented by the formula (1) according to the present invention is not particularly limited, and the compound can be synthesized by combining known reactions.

A method in which an alcohol compound (for example, $R^{12}$—OH) or a phenol compound (for example, HO-[3-ring skeletal structure]-OH) and an alkali metal or an alkali metal alcoholate are used, and these are reacted with a halogen compound (for example, $R^{12}$—X ⇔ X-[3-ring skeletal structure]-X (X is a halogen atom such as a chlorine atom, a bromine atom and an iodine atom, etc.)) can be utilized. For example, it can be prepared in accordance with the method described in Japanese Patent No. 5,916,916.

In particular, the compound (1) represented by the formula (1) according to the present invention can be prepared as follows.

At least one kind of the compound represented by the formula:

[Formula 8]

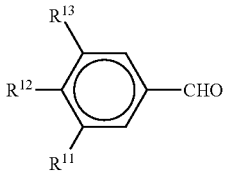

[wherein, $R^{11}$ is hydrogen, a group —OR or a group —$OCH_2CH_2CH(R')CH_2CH_2OR$ (R is a linear or branched $C_nH_{2n+1}$, $4 \leq n \leq 12$, and R' is methyl or ethyl), $R^{12}$ and $R^{13}$ are the same or different from each other, and each is a group —OR or a group —$OCH_2CH_2CH(R')CH_2CH_2OR$ (R is a linear or branched $C_nH_{2n+1}$, $4 \leq n \leq 12$, and R' is methyl or ethyl)], at least one kind of the compound represented by the formula:

[Formula 9]

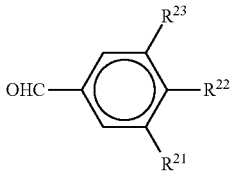

[wherein, $R^{21}$ is hydrogen, a group —OR or a group —$OCH_2CH_2CH(R')CH_2CH_2OR$ (R is a linear or branched $C_nH_{2n+1}$, $4 \leq n \leq 12$, and R' is methyl or ethyl), $R^{22}$ and $R^{23}$ are the same or different from each other, each is a group —OR or a group —$OCH_2CH_2CH(R')CH_2CH_2OR$ (R is a linear or branched $C_nH_{2n+1}$, $4 \leq n \leq 12$, and R' is methyl or ethyl)], and the compound represented by the formula:

[Formula 10]

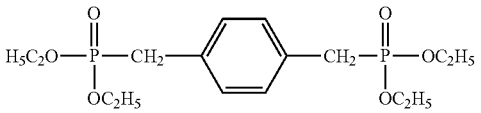

are reacted under appropriate reaction conditions to obtain a mixture of the following compounds

[Formula 11]

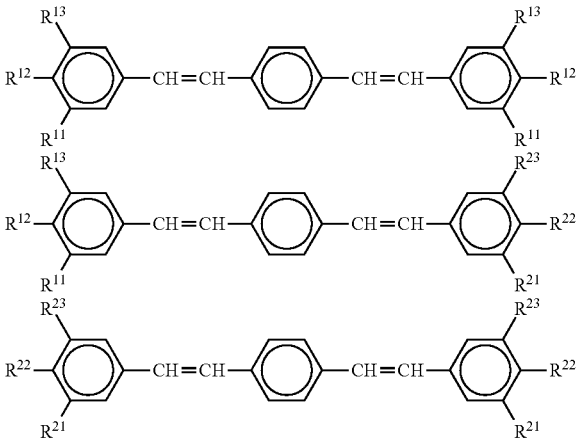

[wherein, $R^{11}$, $R^{12}$, $R^{13}$, $R^{21}$, $R^{22}$ and $R^{23}$ are as defined above] with a molar ratio of 1:2:1.

Incidentally, examples of the above-mentioned alkali metal are potassium carbonate, potassium hydroxide, sodium hydroxide, and the like. Also, examples of the above-mentioned alkali metal alcoholate are sodium ethylate, sodium methylate, sodium tert-butoxide, potassium tert-butoxide, and the like.

Also, in the above-mentioned reaction, conventionally known various kinds of organic solvents can be used and, for example, diethyl ether, tetrahydrofuran (THF), acetone and toluene can be used.

As another method, it can be prepared as follows.

At least one kind of the compound represented by the formula:

[Formula 12]

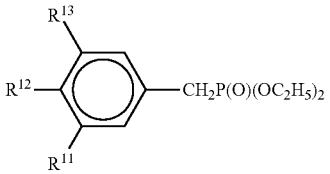

[wherein, $R^{11}$ is hydrogen, a group —OR or a group —$OCH_2CH_2CH(R')CH_2CH_2OR$ (R is a linear or branched $C_nH_{2n+1}$, $4 \leq n \leq 12$, and R' is methyl or ethyl), $R^{12}$ and $R^{13}$ are the same or different from each other, and each is a group —OR or a group —$OCH_2CH_2CH(R')CH_2CH_2OR$ (R is a linear or branched $C_nH_{2n+1}$, $4 \leq n \leq 12$, and R' is methyl or ethyl)], at least one kind of the compound represented by the formula:

[Formula 13]

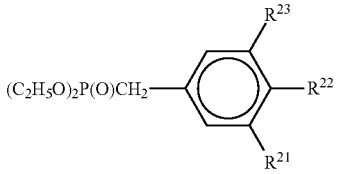

[wherein, $R^{21}$ is hydrogen, a group —OR or a group —$OCH_2CH_2CH(R')CH_2CH_2OR$ (R is a linear or branched $C_nH_{2n+1}$, $4 \leq n \leq 12$, and R' is methyl or ethyl), $R^{22}$ and $R^{23}$ are the same or different from each other, and each is a group —OR or a group —$OCH_2CH_2CH(R')CH_2CH_2OR$ (R is a linear or branched $C_nH_{2n+1}$, $4 \leq n \leq 12$, and R' is methyl or ethyl)], and terephthalaldehyde represented by the formula:

[Formula 14]

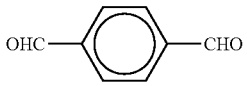

are reacted under appropriate reaction conditions to obtain a mixture of the following compounds

[Formula 15]

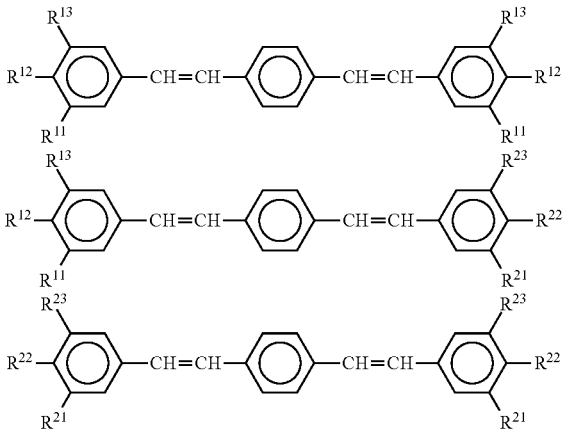

[wherein, $R^{11}$, $R^{12}$, $R^{13}$, $R^{21}$, $R^{22}$ and $R^{23}$ are as defined above] with a molar ratio of 1:2:1.

[Characteristics of Electrically-Conductive Lubricant]

An average dynamic friction coefficient of the electrically-conductive lubricant according to the present invention is preferably 0.13 or less when it is measured at 100° C.

The electrically-conductive lubricant according to the present invention has a conductivity of 0.001 μA or more, more preferably 0.01 μA or more, further preferably 0.07 μA or more preferably in the range of 30° C. to 300° C., when it is injected in a cell having an electrode area of 1 $cm^2$ and a distance between electrodes of 5 μm, and a voltage of 5V is applied between the electrodes. In order to exhibit such a conductivity, it is not necessary to add carbon or metal powder, etc. Therefore, the appearance of the electrically-conductive lubricant according to the present invention is extremely clean, and when oxidative deterioration (yellowing) occurs due to continuous use for a long period of time, it can be detected at an early stage. Furthermore, since the compound itself is a fluorescent substance, for example, by irradiating light from a black light, which is an electric lamp that emits long-wavelength ultraviolet rays, defects such as lubricant leakage can be immediately detected.

Also, the electrically-conductive lubricant according to the present invention has very low volatility (for example, the weight loss after heating at 100° C. for 1 month is 1% or less), and it has a merit that it is possible to continuously use without replenishing for a long period of time as compared with that of the conventional greases, etc.

When the electrically-conductive lubricant according to the present invention is used for applications to which conventional greases are applied, it is not necessary to use a thickener for the electrically-conductive lubricant according to the present invention. According to this, not only the production process is shortened, but also the problems of lowering water resistance or shear stability which tend to occur due to improper selection of the thickener can be avoided.

[Preparation of Electrically-Conductive Lubricant]

Other components that the electrically-conductive lubricant of the present invention may contain as long as the effects of the present invention are not impaired will be explained in order. These are basically conventionally known substances as components contained in the lubricant, and the contents thereof can be appropriately selected by those skilled in the art within the range of conventionally known unless otherwise specifically mentioned. Also, any of the components may be used alone or in combination of two or more kinds.

(Liquid Crystal Compound)

The compound (1) according to the present invention is a liquid crystal compound, and the electrically-conductive lubricant of the present invention may contain other liquid crystal compound(s) than the above.

Examples of such a liquid crystal compound are a liquid crystal compound showing a smectic phase or a nematic phase, an alkylsulfonic acid, a compound having a Nafion film-based structure, an alkylcarboxylic acid, an alkylsulfonic acid, and the like. In addition, liquid crystal compounds disclosed in Japanese Patent No. 5,916,916 and JP 2017-105874A can be suitably contained.

The combined use of these components can further widen the temperature range in which the liquid crystal compound contained in the electrically-conductive lubricant of the present invention forms the liquid crystal phase, and there is a possibility that the advantages of the above-mentioned formation of the liquid crystal phase can be enjoyed in a wide temperature range.

(Base Oil)

When the compound (1) of the present invention is contained in the electrically-conductive lubricant as an additive, as the base oil, conventionally known various kinds of lubricant base oils can be used.

The above-mentioned base oil is not particularly limited and, for example, mineral oil, highly refined mineral oil, synthetic hydrocarbon oil, paraffinic mineral oil, alkyl diphenyl ether oil, ester oil, silicone oil, naphthenic mineral oil and fluorine oil, and the like, can be used. A content of such a base oil in the electrically-conductive lubricant of the present invention is generally 80 to 99% by weight.

(Other Additives)

When the compound of the present invention is contained in the lubricant as a base oil, conventionally known various kinds of additives can be added.

Other additives which can be added to the electrically-conductive lubricant of the present invention are various kinds of additives that are used for lubricants such as bearing oil, gear oil, hydraulic oil, and the like, that is, extreme pressure agents, orientation adsorbents, wear preventing agents, wear adjusting agents, oily agents, antioxidants, viscosity index improvers, pour point depressants, detergent dispersants, metal inactivators, corrosion inhibitors, rust preventive agents, defoaming agents, solid lubricants, and the like.

Examples of the above-mentioned extreme pressure agents are chlorine-based compounds, sulfur-based compounds, phosphoric acid-based compounds, hydroxycarboxylic acid derivatives and organic metal-based extreme pressure agents. By adding the extreme pressure agent, wear resistance of the electrically-conductive lubricant of the present invention is improved.

Examples of the above-mentioned orientation adsorbents are organic silane, organic titanium, organic aluminum and the like represented by various kinds of coupling agents such as silane coupling agents, titanium coupling agents, aluminum coupling agents and the like. By adding the orientation adsorbent, liquid crystal orientation of the liquid crystal compound contained in the electrically-conductive lubricant of the present invention is strengthened, and the thickness and strength of the coating film formed from the electrically-conductive lubricant of the present invention can be strengthened.

The electrically-conductive lubricant of the present invention can be prepared by mixing the compound of the present invention and other components explained above by a conventionally known method. An example of the method for preparing the electrically-conductive lubricant of the present invention is shown as follows.

The constitutional components of the electrically-conductive lubricant are mixed by a conventional method, and thereafter, if necessary, roll milling, defoaming treatment, filter treatment, and the like, are carried out to obtain the electrically-conductive lubricant of the present invention. Or else, the oil component of the electrically-conductive lubricant may be previously mixed, subsequently other components such as additives, and the like are added and mixed, and if necessary, the above-mentioned defoaming treatment, and the like is carried out to prepare the electrically-conductive lubricant.

[Use of Electrically-Conductive Lubricant]

The electrically-conductive lubricant of the present invention exhibits good low viscosity in a wide temperature range as mentioned above, and has a small dynamic friction coefficient, so that it can be used as a lubricant in various kinds of mechanical apparatuses to which grease has conventionally been applied.

A mechanical apparatus generally has a plurality of mechanical elements that are contacted to each other and move relative to each other, and by arranging the electrically-conductive lubricant of the present invention on at least a part of the contact surface of the mechanical elements, friction due to contact with the plurality of the mechanical elements can be reduced and relative movement can be made smooth.

In the present invention, the above-mentioned contact includes not only the case where a plurality of objects is in direct contact, but also the case where the objects are indirectly contacted which are intervening through any substance such as a coating film formed by the electrically-conductive lubricant of the present invention and the like.

That is, when the electrically-conductive lubricant of the present invention is arranged on the contact surface of a plurality of the mechanical elements, a film comprising the composition is formed between a plurality of the mechanical elements, whereby direct contact between the mechanical elements is inhibited. According to this, it can be suitably prevented to cause wear due to friction or seizure between the mechanical elements.

A method of arranging the electrically-conductive lubricant of the present invention on the contact surface of the above-mentioned plurality of the mechanical elements is known to those skilled in the art. Examples of such methods are coating of the composition on the above-mentioned contact surface, and filling of the above-mentioned composition into a certain region in close proximity of the mechanical elements, including the contact surface of the above-mentioned mechanical elements.

Also, the above-mentioned mechanical elements are elements (parts, etc.) constituting various kinds of mechanical apparatuses, including those which are conventionally lubricated with a lubricant, in particular, those to which grease is applied, and those that may be lubricated with a lubricant in the future, in particular, those lubricated with grease.

The contact surface of the above-mentioned plurality of mechanical elements, or more broadly speaking, the contact portion of the mechanical elements may be a flat surface or a curved surface, or at least a part of such a surface may have irregularities or a hole portion may exist. Also, the parts of each mechanical elements constituting the contact part of the mechanical elements may be subjected to surface treatment such as various kinds of modification and the like. The material of the mechanical element is not particularly limited, and may be constituted by any of the material such as a metal material, organic or inorganic material and the like. Also, the type of the constituting material may be different between one of the mechanical elements and the other.

Examples of the mechanical apparatus having such various kinds of mechanical elements are machines for transportation, machines for processing, computer-related equipments, office-related equipments such as copying machines, products for household and the like, and the electrically-conductive lubricant of the present invention can be suitably utilized, for example, for lubrication of the bearings of these various kinds of the mechanical apparatuses.

Specific examples of the above-mentioned bearings are bearings used in automobile electrical components such as electric fan motors and wiper motors; rolling bearings used in automobile engine accessories such as water pumps, electromagnetic clutch devices and the like and drive systems; rolling bearings used in rotating devices such as small to large general-purpose motors for industrial mechanical apparatuses; high-speed and high-precision rotary bearings such as spindle bearings for machine tools, rolling bearings used in motors and rotating devices for household appliances such as air conditioner fan motors and washing machines; rolling bearings used for rotating parts of computer-related equipment such as HDD devices, DVD devices and the like; rolling bearings used for rotating parts of office machines such as copying machines, automatic ticket gates and the like; and axial bearings of electric trains and freight cars.

Also, the electrically-conductive lubricant of the present invention can be used for lubrication of resin pulleys used in CVJ devices, power steering devices for electronic and electric control and the like of automobiles, and lubrication of mechanical elements of various kinds of rolling devices such as linear guides, ball screws and the like.

The electrically-conductive lubricant of the present invention can be utilized, for example, for engine oil or gear oil for vehicles such as automobiles and the like, hydraulic oil for automobiles, lubricating oil for ships and aircraft, machine oil, turbine oil, hydraulic oil, spindle oil, hydraulic compressor and vacuum pump oil, refrigerating machine oil and lubricating oily agent for metal processing, also, hinge oil, sewing machine oil and sliding surface oil, and further, a lubricant (including those used in the horizontal magnetic recording system and in the vertical magnetic recording system utilizing heat assist recording technology and the like) for platter of HDD equipment, a lubricant for magnetic recording media, a lubricant for micromachines, a lubricant for artificial bones and the like. In addition, when it is used in an environment where it is extremely difficult to replace the lubricant, such as in wind power generation, polar regions, and space-related applications, the lubricant of the present invention with little loss due to evaporation, decomposition, etc., over a long period of time is particularly useful.

Examples

Hereinafter, the present invention will be explained in more detail by referring to Examples, but the present invention is not limited to these.

[Measurement of Various Physical Properties]

Various physical properties of the test product were carried out by the following method.

(Confirmation of Structure of Compound)

It was carried out by 1H-NMR.

(Dynamic Friction Coefficient of Compound)

The dynamic friction coefficient of the compound can be measured by a commercially available dynamic friction coefficient measurement device, and in the present specification, the dynamic friction coefficient is measured using a surface property measuring machine "TYPE:14FW" manufactured by Shinto Scientific Co., Ltd.

The dynamic friction coefficient of the compound according to the present invention is affected by the temperature, so that the above-mentioned dynamic friction coefficient is measured at a predetermined measurement temperature (100° C.).

Specifically, a stainless steel plate is fixed to the moving table of the above-mentioned surface property measuring machine and a sample is dropped, and under the following conditions, point pressure is applied with a fixed ball and wear due to reciprocating motion is repeated, a dynamic friction coefficient at every 100 reciprocating times is measured up to 1,800 times, and these average values (average dynamic friction coefficient) are calculated. This average value is taken as an average dynamic friction coefficient of the compound according to the present invention.

The measurement conditions are as follows.

Vertical load: 100 g
Friction speed: 600 mm/min
Reciprocating times: 1,800
Reciprocating stroke: 5 mm
Load transducer capacity: 19.61N
Friction partner material: SUS304 stainless steel ball diameter 10 mm
Sample amount: 0.2 mL (Liquid Crystallinity of Compound)

According to observation using a polarizing microscope, glass state, liquid crystal state (smectic phase) and the like were judged.

(Conductivity of Compound)

A sample was injected between ITO electrodes having an area of 1 $cm^2$ with the distance between the electrodes set to 5 μm, and using Advantest ADCMT 6241A as a voltage application current measurement device and METTLER FP900 thermo system as a temperature controller, respectively, a current value was measured with an applied voltage of 5V in a temperature range of 30° C. to 300° C. The measurement was carried out each twice to confirm immobilization of the liquid crystal.

(Fluorescence Spectrum of Compound)

The measurement was carried out under the following conditions using a F-7000 type spectrophotofluorometer (manufactured by Hitachi High-Tech Science Corporation).

Excitation wavelength: 371.0 nm

Fluorescence start wavelength: 200.0 nm

Fluorescence end wavelength: 700.0 nm

Scan speed: 240 nm/min.

Excitation side slit: 5.0 nm

Fluorescent side slit: 5.0 nm

Photomultiplier voltage: 400 V

[Synthesis of Compound]

Synthetic Examples of the compounds according to the present invention are shown below.

Synthetic Example 1, Synthesis of Liquid Crystal Compound (9-1)

First, an aldehyde raw material is prepared.

[Formula 16]

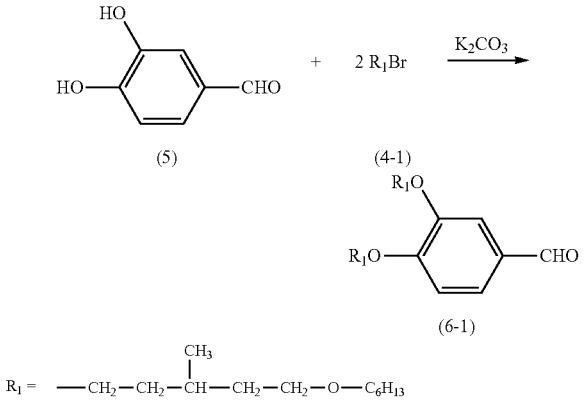

In a 500 mL of an Erlenmeyer flask, 5.5 g (0.040 mol) of 3,4-dihydroxybenzaldehyde (5) and 16.6 g (0.12 mol) of potassium carbonate were dissolved in 150 mL of DMF, and the mixture was stirred under nitrogen atmosphere at 50° C. for 1 hour in a silicone bath. Thereafter, 27.0 g (0.10 mol) of a bromine compound (4-1) was added thereto and the mixture was stirred at 80° C. for 48 hours in the silicone bath.

The reaction mixture was poured into 300 mL of 10% cold dil. hydrochloric acid, and extracted with 300 mL of diethyl ether using 1 L of a separatory funnel. The obtained ether layer was washed with 300 mL of distilled water. The aqueous layer was extracted again with 100 mL of diethyl ether. The obtained ether layers were combined, and anhydrous sodium sulfate was added thereto to dehydrate it overnight.

Anhydrous sodium sulfate was removed by suction filtration, and the solvent was removed an evaporator under reduced pressure. Unreacted bromine compound (4-1) was removed by an evaporator (200° C. oil bath) under reduced pressure. The residue was washed with methanol to obtain the objective material (6-1) from the soluble portion.

The results are as follows.

Theoretical yielded amount: 20.3 g

Yielded amount: 19.8 g

Yield: 98%

State: Brownish solid

Next, the liquid crystal compound is obtained from the above-mentioned aldehyde raw material.

[Formula 17]

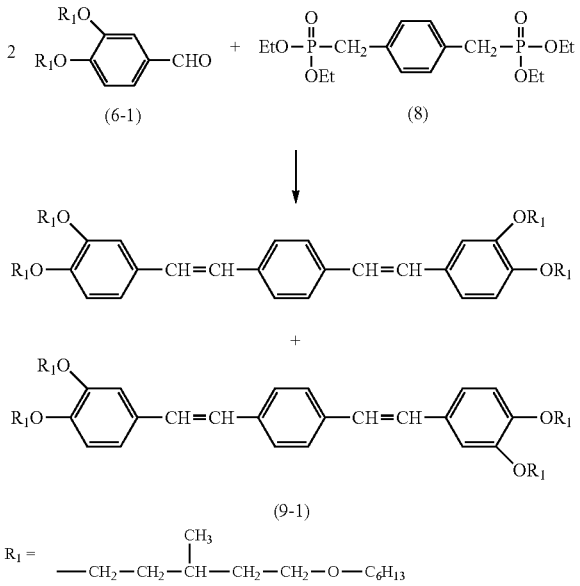

To 300 mL of an Erlenmeyer flask were added 4.1 g (0.0080 mol) of an aldehyde compound (6-1), 1.5 g (0.0040 mol) of a compound (8), and 50 mL of THF as a solvent. To the mixture was added dropwise 1.4 g (0.012 mol) of potassium t-butoxide dissolved in 50 mL of THF drop by drop, and the mixture was stirred at 30° C. for 24 hours under nitrogen atmosphere.

After adding 5 mL of hydrochloric acid, THF was removed by evaporation under reduced pressure. Thereafter, the obtained solid was washed with methanol and hexane.

Thereafter, the residue was dissolved in 10 to 20 mL of THF, 200 mL of distilled water was added thereto to carry out ultrasonic cleaning, and charged in a refrigerator overnight. The objective material precipitated at the wall surface of the apparatus was obtained by decantation. Incidentally, if the amount of the objective material is insufficient, distilled water is concentrated by an evaporator and the concentrate may be charged again in a refrigerator overnight to obtain the objective material. Depending on necessity, column chromatography was carried out to obtain the objective material (9-1).

The results are as follows.

Theoretical yielded amount: 4.3 g

Yielded amount: 1.7 g

Yield: 40%

State: Yellowish viscous solid

The structure of the compound of the formula (9-1) synthesized in accordance with the above-mentioned method is shown below.

TABLE 1

| Compound No. | $R_1$ |
|---|---|
| (9-1-1) | $—OCH_2CH_2CH(CH_3)CH_2CH_2OC_6H_{13}$ |
| (9-1-2) | $—OCH_2CH_2CH(CH_3)CH_2CH_2OC_7H_{15}$ |
| (9-1-3) | $—OCH_2CH_2CH(CH_3)CH_2CH_2OC_8H_{17}$ |
| (9-1-4) | $—OCH_2CH_2CH(CH_3)CH_2CH_2OC_{10}H_{21}$ |
| (9-1-5) | Mixture of (9-1-1), a compound in which $R_1$ in one of the benzene rings is $—OCH_2CH_2CH(CH_3)CH_2CH_2OC_6H_{13}$ and $R_1$ in the other benzene ring is $—OCH_2CH_2CH(CH_3)CH_2CH_2OC_7H_{15}$ and (9-1-2) with a molar ratio of 1:2:1 |
| (9-1-6) | Mixture of (9-1-2), a compound in which $R_1$ in one of the benzene rings is $—OCH_2CH_2CH(CH_3)CH_2CH_2OC_7H_{15}$ and $R_1$ in the other benzene ring is $—OCH_2CH_2CH(CH_3)CH_2CH_2OC_8H_{17}$ and (9-1-3) with a molar ratio of 1:2:1 |

Synthetic Example 2, Synthesis of Liquid Crystal Compound

A halide raw material is prepared and subjected to coupling using terephthalaldehyde to obtain a liquid crystal compound.

[Formula 18]

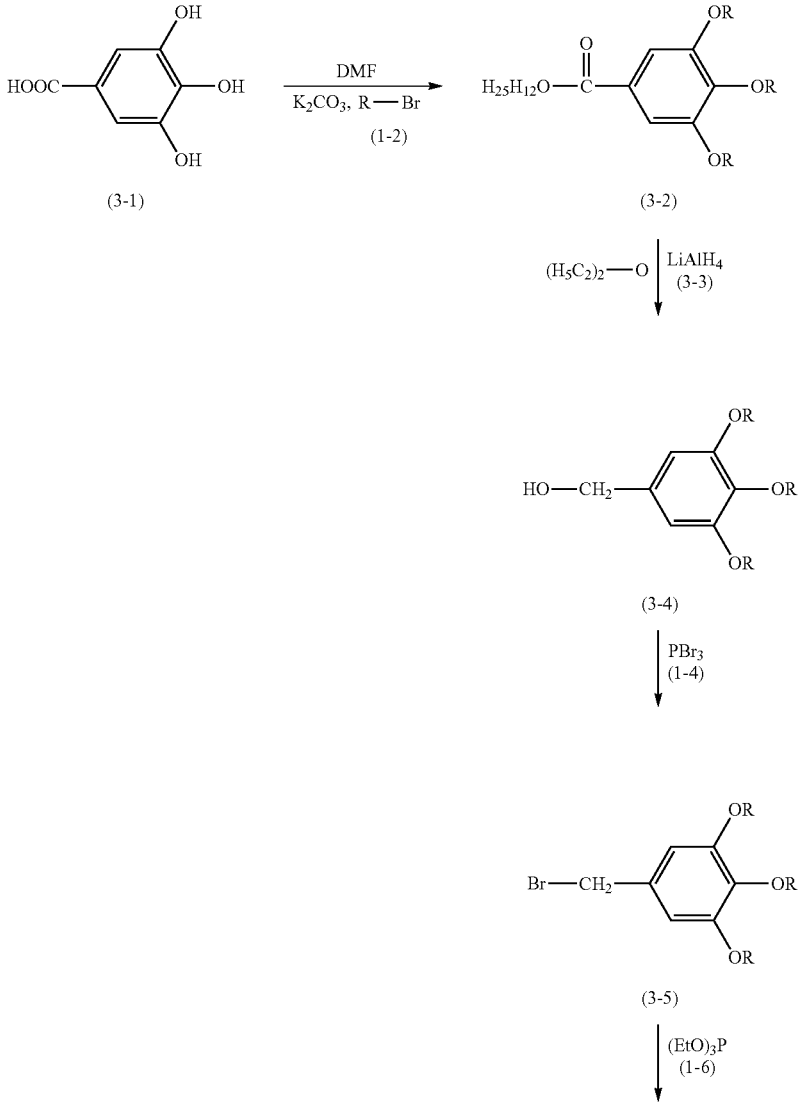

-continued

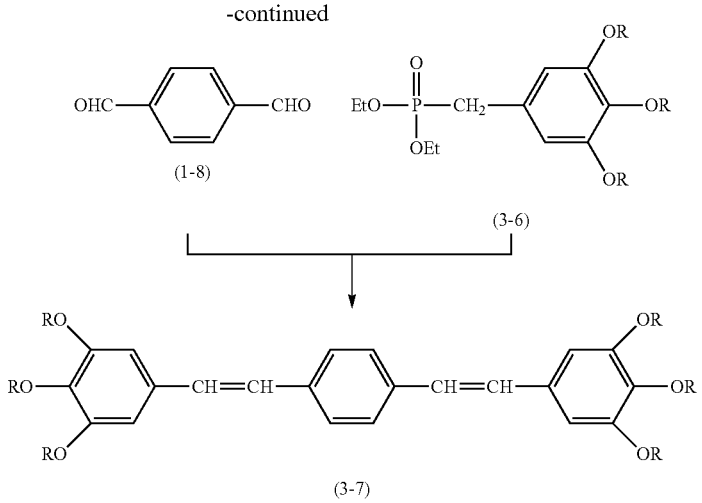

R = $C_{10}H_{21}$

Using 300 mL of an Erlenmeyer flask, 1.94 g (0.015 mol) of terephthalaldehyde (1-8) and 19.93 g (0.03 mol) of the compound (3-6) were dissolved in THF. 6.8 g (0.06 mol) of potassium t-butoxide was dissolved in 50 mL of THF as a base, and the solution was added dropwise at room temperature over 40 minutes. Thereafter, the mixture was stirred under nitrogen atmosphere overnight.

After the reaction, THF was removed by an evaporator under reduced pressure, and 150 mL of methanol was added to the residue to obtain a methanol-insoluble portion. This was further subjected to ultrasonic cleaning with 100 mL of methanol several times repeatedly, and the obtained objective material (3-7) was dried in vacuum overnight.

The results are as follows.

Yielded amount: 18.2 g

Yield: 99.4%

State: Pale yellow solid

By further purifying with acetone, a compound (confirmed by 1H-NMR) in which the groups bonded to the two —CH=CH— were both in the positional relationship of trans was obtained as a pale yellow powder solid. Incidentally, by configuring the trans-isomer alone, it becomes easy to form an aggregate, it is difficult to evaporate, and conductivity can be improved. On the other hand, if a cis-isomer is contained, there is a fear of inhibiting the said action.

[Liquid Crystallinity of Compound]

The results observing liquid crystallinity with a polarizing microscope are shown in the following Table.

TABLE 2

| Compound No. | Liquid crystallinity |
|---|---|
| (9-1-1) | G ⇄ (-50° C. or lower) Sm1 ⇄ (58° C.) Sm2 → (328° C.) dec. |
| (9-1-2) | G ⇄ (-50° C. or lower) Sm1 ⇄ (56° C.) Sm2 → (308° C.) dec. |
| (9-1-3) | G ⇄ (-50° C. or lower) Sm1 ⇄ (55° C.) Sm2 → (303° C.) dec. |

TABLE 2-continued

| Compound No. | Liquid crystallinity |
|---|---|
| (9-1-4) | G ⇄ (-50° C. or lower) Sm1 ⇄ (53° C.) Sm2 → (323° C.) dec. |
| (9-1-5) | G ⇄ (-50° C. or lower) Sm1 ⇄ (56° C.) Sm2 → (307° C.) dec. |

G: glass

Sm: smectic phase dec.: decomposition (Smectic Phase at the Low Temperature Side is Made Sm1, and Smectic Phase at the High Temperature Side is Made Sm2)

It was found that the smectic liquid crystal phase existed in a wide range from −50° C. to +300° C. or higher. It is one of the remarkable characteristic features of the compound according to the present invention to show a liquid crystal phase at normal temperature.

The result of the differential thermal analysis of the compound No. [9-1-1] is shown in FIG. 1. The curve having an inflection point at 59.59° C. is the DTA curve, and the curve descending from around 400° C. is the TG curve. Whereas structural changes occur around 60° C. and around 420° C., it shows the compound is stable therebetween. It is also one of the remarkable characteristic features of the compound according to the present invention that it does not cause evaporation, decomposition and the like in a temperature range of 30° C. to 300° C.

[Electrical-Conductivity of Compound]

The changes in the electrical-conductivity of the compound Nos. [9-1-1], [9-1-2], [9-1-3], [9-1-4] and [9-1-5] with temperature are shown in the following Tables 3 to 7.

TABLE 3

| Electrical-conductivity of compound No. [9-1-1] | | |
|---|---|---|
| Temperature (° C.) | Voltage (V) | Current value (μA) |
| 30 | 5 | 6.0026 |
| 40 | 5 | 0.0159 |
| 50 | 5 | 0.0588 |
| 60 | 5 | 2.1968 |
| 70 | 5 | 0.1094 |
| 80 | 5 | 0.1375 |
| 90 | 5 | 17.8538 |
| 100 | 5 | 1.5771 |
| 110 | 5 | 4.207 |
| 120 | 5 | 1.882 |
| 130 | 5 | 1.7654 |
| 140 | 5 | 2.4169 |
| 150 | 5 | 3.2754 |
| 160 | 5 | 4.1522 |
| 170 | 5 | 4.8944 |
| 180 | 5 | 6.1288 |
| 190 | 5 | 8.0835 |
| 200 | 5 | 11.5971 |
| 210 | 5 | 16.5058 |
| 220 | 5 | 19.1733 |
| 230 | 5 | 14.7291 |
| 240 | 5 | 9.665 |
| 250 | 5 | 8.101 |
| 260 | 5 | 13.52 |
| 270 | 5 | 8.6681 |
| 280 | 5 | 5.8342 |
| 290 | 5 | 4.7632 |
| 300 | 5 | 4.7254 |

TABLE 4

| Electrical-conductivity of compound No. [9-1-2] | | |
|---|---|---|
| Temperature (° C.) | Voltage (V) | Current value (μA) |
| 30 | 5 | 1.271 |
| 40 | 5 | 0.3639 |
| 50 | 5 | 0.134 |
| 60 | 5 | 0.252 |
| 70 | 5 | 0.315 |
| 80 | 5 | 0.3018 |
| 90 | 5 | 4.4199 |
| 100 | 5 | 2.6547 |
| 110 | 5 | 3.1428 |
| 120 | 5 | 0.9698 |
| 130 | 5 | 2.5159 |
| 140 | 5 | 1.8648 |
| 150 | 5 | 1.1846 |
| 160 | 5 | 1.193 |
| 170 | 5 | 1.4788 |
| 180 | 5 | 1.4877 |
| 190 | 5 | 1.7764 |
| 200 | 5 | 1.1221 |
| 210 | 5 | 1.6562 |
| 220 | 5 | 2.896 |
| 230 | 5 | 1.5948 |
| 240 | 5 | 1.6807 |
| 250 | 5 | 1.6522 |
| 260 | 5 | 2.6974 |
| 270 | 5 | 2.5657 |
| 280 | 5 | 3.5319 |
| 290 | 5 | 4.2076 |
| 300 | 5 | 4.474 |

TABLE 5

| Electrical-conductivity of compound No. [9-1-3] | | |
|---|---|---|
| Temperature (° C.) | Voltage (V) | Current value (μA) |
| 30 | 5 | 0.4974 |
| 40 | 5 | 0.2104 |
| 50 | 5 | 0.073 |
| 60 | 5 | 0.1714 |
| 70 | 5 | 0.2571 |
| 80 | 5 | 0.1514 |
| 90 | 5 | 0.1697 |
| 100 | 5 | 0.1407 |
| 110 | 5 | 0.249 |
| 120 | 5 | 0.353 |
| 130 | 5 | 0.3509 |
| 140 | 5 | 0.5664 |
| 150 | 5 | 0.2277 |
| 160 | 5 | 0.2179 |
| 170 | 5 | 0.2891 |
| 180 | 5 | 0.3344 |
| 190 | 5 | 0.3864 |
| 200 | 5 | 0.4311 |
| 210 | 5 | 0.4567 |
| 220 | 5 | 0.4779 |
| 230 | 5 | 0.5196 |
| 240 | 5 | 0.4994 |
| 250 | 5 | 0.4883 |
| 260 | 5 | 0.4551 |
| 270 | 5 | 0.4683 |
| 280 | 5 | 0.4899 |
| 290 | 5 | 0.5577 |
| 300 | 5 | 0.6964 |

TABLE 6

| Electrical-conductivity of compound No. [9-1-4] | | |
|---|---|---|
| Temperature (° C.) | Voltage (V) | Current value (μA) |
| 30 | 5 | 5.6613 |
| 40 | 5 | 2.4862 |
| 50 | 5 | 4.3051 |
| 60 | 5 | 2.2892 |
| 70 | 5 | 4.1668 |
| 80 | 5 | 2.4289 |
| 90 | 5 | 7.3336 |
| 100 | 5 | 3.208 |
| 110 | 5 | 2.9132 |
| 120 | 5 | 0.4281 |
| 130 | 5 | 0.9032 |
| 140 | 5 | 4.1524 |
| 150 | 5 | 3.2689 |
| 160 | 5 | 0.5141 |
| 170 | 5 | 0.5847 |
| 180 | 5 | 0.6529 |
| 190 | 5 | 0.7263 |
| 200 | 5 | 0.8055 |
| 210 | 5 | 0.8873 |
| 220 | 5 | 1.0147 |
| 230 | 5 | 1.0852 |
| 240 | 5 | 1.1924 |
| 250 | 5 | 1.3158 |
| 260 | 5 | 1.5462 |
| 270 | 5 | 1.7639 |
| 280 | 5 | 2.1459 |
| 290 | 5 | 2.5774 |
| 300 | 5 | 3.1378 |

TABLE 7

| Electrical-conductivity of compound No. [9-1-5] | | |
|---|---|---|
| Temperature (° C.) | Voltage (V) | Current value (μA) |
| 30 | 5 | 12.7121 |
| 40 | 5 | 10.265 |
| 50 | 5 | 7.0502 |
| 60 | 5 | 5.6576 |
| 70 | 5 | 3.6713 |
| 80 | 5 | 3.8685 |
| 90 | 5 | 6.141 |
| 100 | 5 | 9.5427 |
| 110 | 5 | 10.4277 |
| 120 | 5 | 8.4399 |
| 130 | 5 | 12.2677 |
| 140 | 5 | 16.9047 |
| 150 | 5 | 21.2201 |
| 160 | 5 | 18.2195 |
| 170 | 5 | 11.415 |
| 180 | 5 | 3.2614 |
| 190 | 5 | 2.594 |
| 200 | 5 | 2.7403 |
| 210 | 5 | 3.1234 |
| 220 | 5 | 3.5099 |
| 230 | 5 | 4.039 |
| 240 | 5 | 4.6312 |
| 250 | 5 | 5.2222 |
| 260 | 5 | 7.9326 |
| 270 | 5 | 8.3911 |
| 280 | 5 | 8.8213 |
| 290 | 5 | 7.8095 |
| 300 | 5 | 8.0776 |

Figure 2:
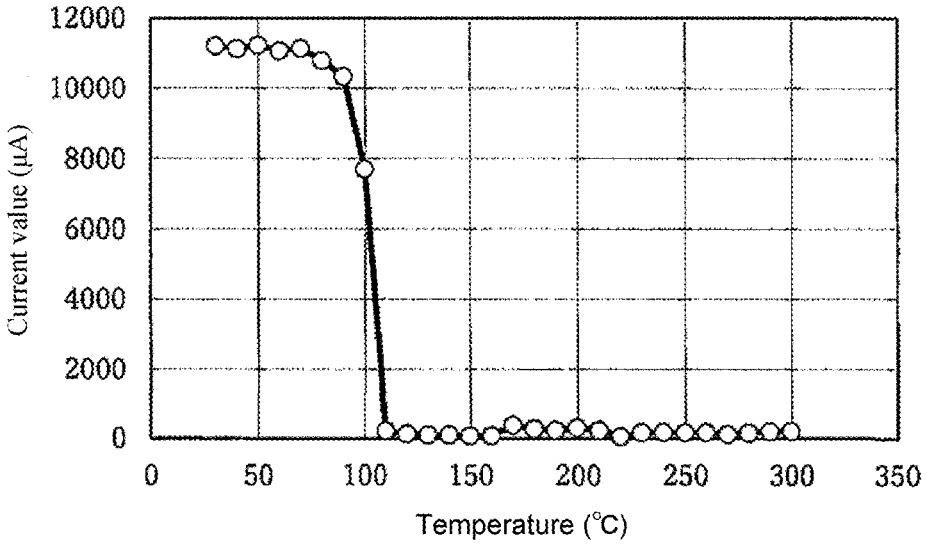
FIG. 2 is a drawing showing conductivity of a compound for an electrically-conductive lubricant according to the present invention.

As mentioned above, it is one of the remarkable characteristic features of the compound according to the present invention to show electrical-conductivity in a wide temperature range of 30° C. to 300° C. Change in electrical-conductivity of the compound No. [3-7] with temperature is shown in FIG. 2. This compound having each three substituents on the benzene rings at both ends has remarkable characteristic feature in the point that it exhibits high electrical-conductivity of 10,000 μA or more in the range of 30° C. to 90° C. and also 7,500 μA or more in the range of 30° C. to 100° C.

[Dynamic Friction Coefficient of Compound]

Measurement of the dynamic friction coefficient was carried out with respect to the compound No. [9-1-6] and DOS (the following structural formula: dioctyl sebacate), which has been widely used as a lubricating oil. The results are shown in the following Table 8.

[Formula 19]

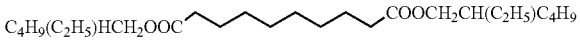

TABLE 8

| Tested materials | Average dynamic friction coefficient |
|---|---|
| Compound [9-1-6] | 0.120856 |
| DOS | 0.237602 |

[Fluorescent Spectrum of Compound]

Figure 3:
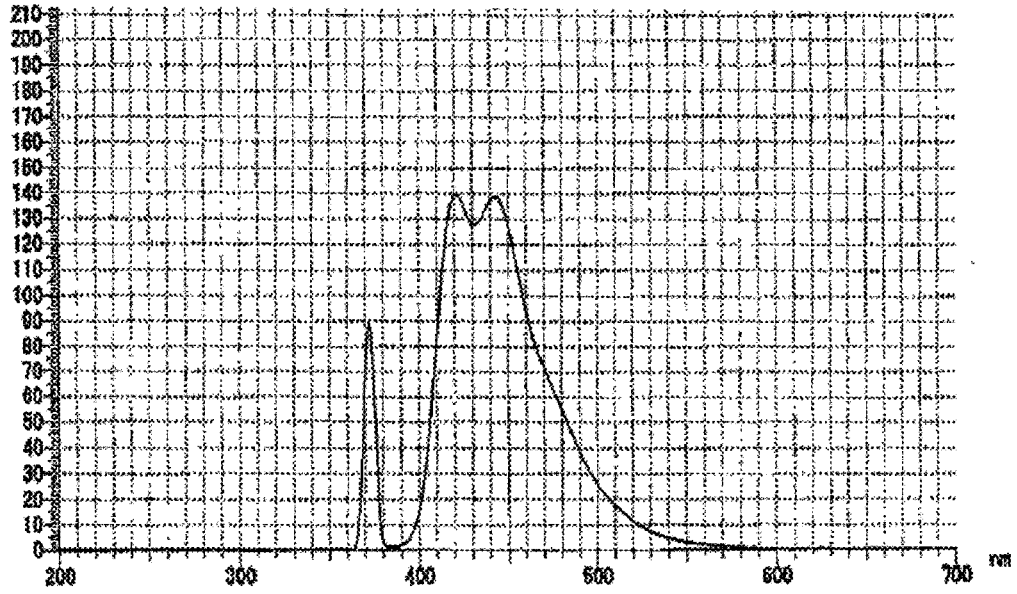
FIG. 3 is a drawing showing a fluorescence spectrum of a compound for an electrically-conductive lubricant according to the present invention.
Figure 3:
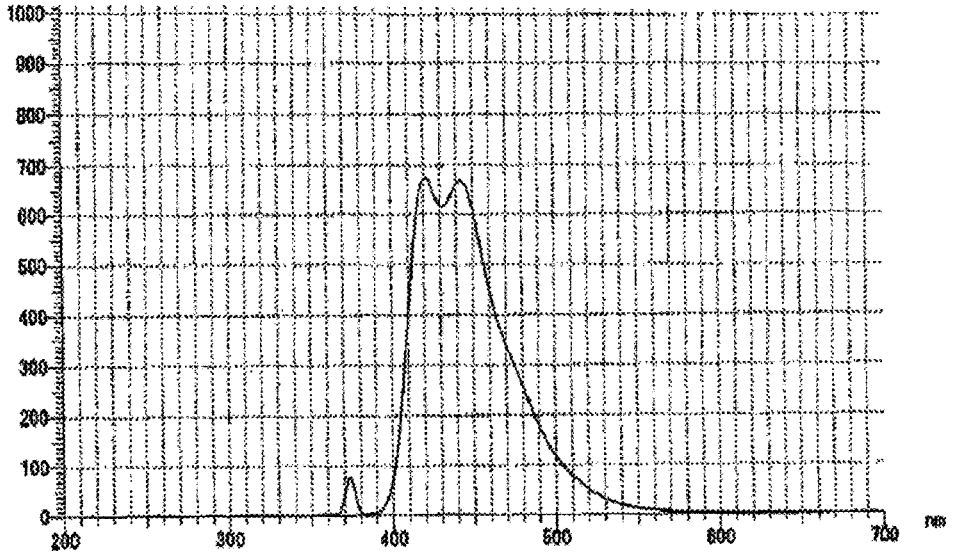

The measurement results of the fluorescence spectra of compounds Nos. [9-1-3] and [9-1-4] are shown in FIGS. 3(A) and (B), respectively. Peaks are observed at 420.8 nm and 443.6 nm, and it can be understood to emit blue fluorescence. It is one of the remarkable characteristic features of the compound according to the present invention that the defects such as leakage of the lubricant can be immediately found by irradiating light from a black light, which is an electric lamp that emits ultraviolet rays of long wavelength, to emit light of the compounds Nos. [9-1-3] and [9-1-4], and confirming the presence or absence of the light emission.

Utilizability in Industry

The liquid crystal compound according to the present invention has characteristics in combination that it exhibits liquid crystallinity in a wide temperature range, retains a low dynamic friction coefficient, has electrical-conductivity, has almost no loss due to evaporation, decomposition and the like, has a clean appearance, and emits fluorescence, and can find deterioration or leakage immediately, so that it is extremely useful as a raw material of the electrically-conductive lubricant.

Lubricants are substances that are generally applied to moving parts of machines to reduce friction between parts which come into contact with each other, prevent generation of frictional heat, prevent stress from concentrating on the contacted portions between parts. Also, the lubricants play a role of sealing, rust prevention, dust prevention, and the like. In the lubricants, lubricating oils and greases are contained. The lubricating oils are generally mixed oils such as refined petroleum products, and the like. On the other hand, the greases are materials in which the lubricating oils are retained to a thickener to provide it thixotropic properties for the purpose of applying it to sliding surfaces (for example, plain bearings and rolling bearings) which are difficult to keep with a lubricant film.

For such a lubricant, various characteristics are required to, needless to say, exhibit a low friction coefficient, and to have a wide usable temperature range, low loss due to evaporation, decomposition, etc., over a long period of time, and the like.

In Patent Document 1, a lubricant for a bearing in which a liquid crystal compound and grease are mixed is described. In Patent Documents 2 to 5, there are disclosed that, by using a specific liquid crystal compound, a lubricant which is effective in a wide temperature range with a little evaporation amount over a long period of time can be produced. In Patent Document 5, a heat resistant electrically-conductive lubricant comprising a liquid crystal mixture in which a bicyclic liquid crystal compound and a tricyclic liquid crystal compound are mixed is described. According to the document, there is described that, by mixing the bicyclic liquid crystal compound and the tricyclic liquid crystal compound with a ratio of 1:1, a lubricant which exhibits liquid crystallinity in the range of −50° C. to +220° C. can be produced.

PRIOR ART DOCUMENTS

Patent Documents

Patent Document 1: JP 2004-359848A
Patent Document 2: JP 2015-199934A
Patent Document 3: JP 2016-130316A
Patent Document 4: JP 2016-150954A
Patent Document 5: JP 2017-105874A

SUMMARY OF INVENTION

Problems to be Solved by the Invention

An object of the present invention is to provide a lubricant composition suitable for use in a clean environment where low dusting characteristic is required, under a high vacuum such as outer space and the like, or under high temperature and a bearing in which the lubricant composition is sealed.

Means to Solve the Problems

The present inventors have found a liquid crystal mixture which can exhibit excellent properties as a lubricant by mixing a bicyclic liquid crystal compound and a tricyclic liquid crystal compound having specific structures with a specific ratio, and completed the present invention. That is, the present invention includes the following.

[1]

A lubricant composition which comprises at least one kind of a bicyclic liquid crystal compound represented by the following formula (1) and at least one kind of a tricyclic liquid crystal compound represented by the following formula (2), and a mixing ratio of the above-mentioned bicyclic liquid crystal compound and the above-mentioned tricyclic liquid crystal compound is 95:5 to 15:85 in a mass ratio.

Formula (1):

[Formula 20]

(1)

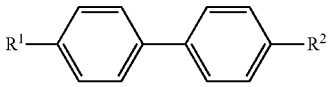

[wherein, $R^1$ and $R^2$ are the same or different from each other, and each is a group —$OCH_2CH_2CH(R')CH_2CH_2OR$ (R is a linear or branched $C_nH_{2n+1}$, $1 \leq n \leq 20$, and R' is methyl or ethyl)]

Formula (2):

[Formula 21]

(2)

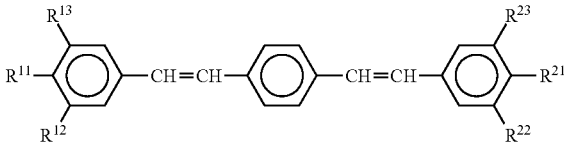

[wherein, $R^{11}$ and $R^{21}$ are the same or different from each other, and each is a group —OR (R is a linear or branched $C_nH_{2n+1}$, and $1 \leq n \leq 20$), $R^{12}$, $R^{13}$, $R^{22}$ and $R^{23}$ are the same or different from each other, and each is hydrogen or a group —OR (R is a linear or branched $C_nH_{2n+1}$, and $1 \leq n \leq 20$)]

[2]

The lubricant composition described in [1], wherein, in the above formula (1), $1 \leq n \leq 15$, and R' is methyl.

[3]

The lubricant composition described in [1] or [2], wherein the tricyclic liquid crystal compound is at least one kind among the compounds represented by the following formulae (3) to (5).

[Formula 22]

(3)

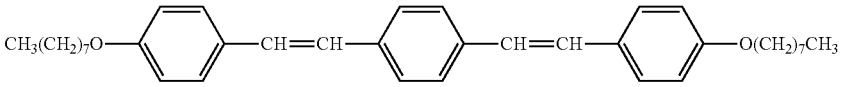

(4)

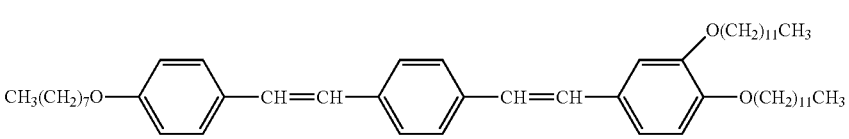

(5)

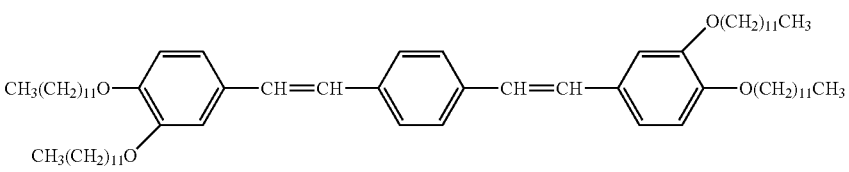

[4]

The lubricant composition described in any of [1] to [3], wherein the above-mentioned bicyclic liquid crystal compound is more contained than the above-mentioned tricyclic liquid crystal compound.

[5]

The lubricant composition described in any of [1] to [4], wherein a remaining ratio in an atmosphere at a temperature of 100° C. after lapse of 600 hours is 95% or more.

[6]

The lubricant composition described in any of [1] to [5], wherein a remaining ratio in an atmosphere at a temperature of 25° C. and a pressure of $10^{-5}$ Pa after lapse of 1,000 hours is 95% or more.

[7]

A bearing in which the lubricant composition described in any of [1] to [6] is sealed.

Effects of the Invention

According to the present invention, it is possible to provide a lubricant composition suitable for use in a clean environment, under a high vacuum or under high temperature and a bearing in which the lubricant composition is sealed.

Embodiments to Carry Out the Invention

According to the present invention, it is provided a lubricant composition which comprises at least one kind of a bicyclic liquid crystal compound represented by the following formula (1) and at least one kind of a tricyclic liquid crystal compound represented by the following formula (2), and a mixing ratio of the bicyclic liquid crystal compound and the tricyclic liquid crystal compound is 95:5 to 15:85 in a mass ratio.

Formula (1):

[Formula 23]

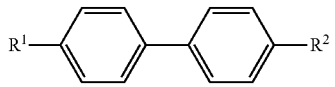

(1)

[wherein, $R^1$ and $R^2$ are the same or different from each other, and each is a group —$OCH_2CH_2CH(R')CH_2CH_2OR$ (R is a linear or branched $C_nH_{2n+1}$, $1 \le n \le 20$, and R' is methyl or ethyl)]

Formula (2):

[Formula 24]

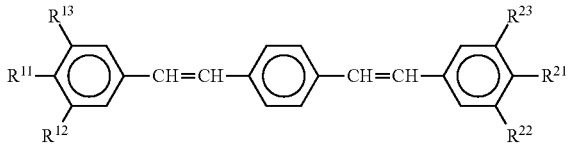

(2)

[wherein, $R^{11}$ and $R^{21}$ are the same or different from each other, and each is a group —OR (R is a linear or branched $C_nH_{2n+1}$, and $1 \le n \le 20$), $R^{12}$, $R^{13}$, $R^{22}$ and $R^{23}$ are the same or different from each other, and each is hydrogen or a group —OR (R is a linear or branched $C_nH_{2n+1}$, and $1 \le n \le 20$)]

In the formulae (1) and (2), $R^1$, $R^2$, $R^{12}$, $R^{13}$, $R^{21}$, $R^{22}$ and $R^{23}$ are chain groups that are each linked to the core structure, and responsible for lubricity of the molecule. By appropriately selecting $R^1$, $R^2$, $R^{11}$, $R^{12}$, $R^{13}$, $R^{21}$, $R^{22}$ and $R^{23}$, the size (long axis) and polarity of the whole molecule can be adjusted.

Examples of R in the formulae (1) and (2) are an n-butyl group, an isobutyl group, a sec-butyl group, a tert-butyl group, an n-pentyl group, a 1-methyl-n-butyl group, a 2-methyl-n-butyl group, a 3-methyl-n-butyl group, a 1,1-dimethyl-n-propyl group, a 1,2-dimethyl-n-propyl group, a 2,2-dimethyl-n-propyl group, a 1-ethyl-n-propyl group, an n-hexyl group, a 1-methyl-n-pentyl group, a 2-methyl-n-pentyl group, a 3-methyl-n-pentyl group, a 4-methyl-n-pentyl group, a 1,1-dimethyl-n-butyl group, a 1,2-dimethyl-n-butyl group, a 1,3-dimethyl-n-butyl group, a 2,2-dimethyl-n-butyl group, a 2,3-dimethyl-n-butyl group, a 3,3-dimethyl-n-butyl group, a 1-ethyl-n-butyl group, a 2-ethyl-n-butyl group, a 1,1,2-trimethyl-n-propyl group, a 1,2,2-trimethyl-n-propyl group, a 1-ethyl-1-methyl-n-propyl group, a 1-ethyl-2-methyl-n-propyl group, an n-heptyl group, a 1-methyl-n-hexyl group, a 2-methyl-n-hexyl group, a 3-methyl-n-hexyl group, a 1,1-dimethyl-n-pentyl group, a 1,2-dimethyl-n-pentyl group, a 1,3-dimethyl-n-pentyl group, a 2,2-dimethyl-n-pentyl group, a 2,3-dimethyl-n-pentyl group, a 3,3-dimethyl-n-pentyl group, a 1-ethyl-n-pentyl group, a 2-ethyl-n-pentyl group, a 3-ethyl-n-pentyl group, a 1-methyl-1-ethyl-n-butyl group, a 1-methyl-2-ethyl-n-butyl group, a 1-ethyl-2-methyl-n-butyl group, a 2-methyl-2-ethyl-n-butyl group, a 2-ethyl-3-methyl-n-butyl group, an n-octyl group, a 1-methyl-n-heptyl group, a 2-methyl-n-heptyl group, a 3-methyl-n-heptyl group, a 1,1-dimethyl-n-hexyl group, a 1,2-dimethyl-n-hexyl group, a 1,3-dimethyl-n-hexyl group, a 2,2-dimethyl-n-hexyl group, a 2,3-dimethyl-n-hexyl group, a 3,3-dimethyl-n-hexyl group, a 1-ethyl-n-hexyl group, a 2-ethyl-n-hexyl group, a 3-ethyl-n-hexyl group, a 1-methyl-1-ethyl-n-pentyl group, a 1-methyl-2-ethyl-n-pentyl group, a 1-methyl-3-ethyl-n-pentyl group, a 2-methyl-2-ethyl-n-pentyl group, a 2-methyl-3-ethyl-n-pentyl group, a 3-methyl-3-ethyl-n-pentyl group, an n-nonyl group, an n-decyl group, an n-undecyl group, an n-dodecyl group and the like.

In the formula (1), $R^1$ and $R^2$ are the same or different from each other, and each is a group —$OCH_2CH_2CH(R')CH_2CH_2OR$ (R is a linear or branched $C_nH_{2n+1}$, $1 \le n \le 20$, preferably $1 \le n \le 15$, more preferably $4 \le n \le 12$, particularly preferably $8 \le n \le 10$, and R' is methyl or ethyl).

In the formula (1), it is preferably $1 \le n \le 15$, and R' is methyl.

In the formula (2), $R^{11}$ and $R^{21}$ are the same or different from each other, and each is a group —OR (R is a linear or branched $C_nH_{2n+1}$, $1 \le n \le 20$, preferably $4 \le n \le 16$, and more preferably $8 \le n \le 12$).

In the formula (2), $R^{12}$, $R^{13}$, $R^{22}$ and $R^{23}$ are the same or different from each other, and each is hydrogen or a group —OR (R is a linear or branched $C_nH_{2n+1}$, $1 \le n \le 20$, preferably $4 \le n \le 16$, and more preferably $8 \le n \le 12$).

The tricyclic liquid crystal compound represented by the formula (2) is preferably at least one kind among the compounds represented by the following formulae (3) to (5).

[Formula 25]

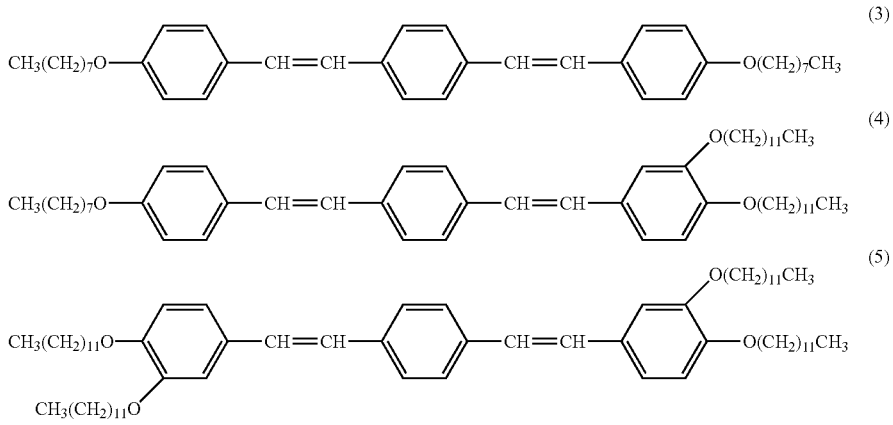

The bicyclic liquid crystal compound represented by the formula (1) is preferably at least one kind among, for example, the compounds represented by the following formulae (6) to (8).

[Formula 26]

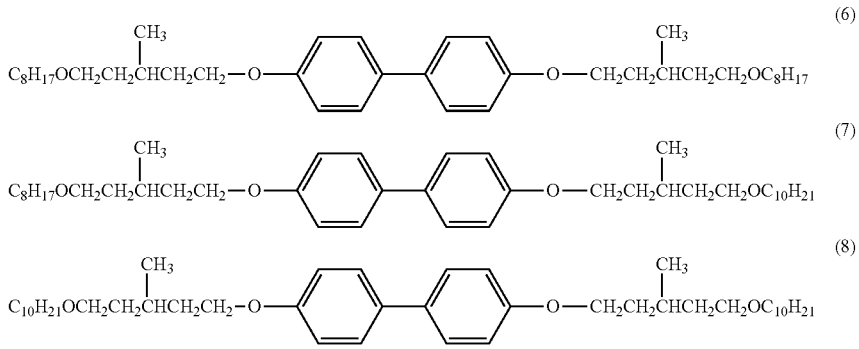

In the present invention, the tricyclic liquid crystal compound represented by the formula (2) may be used alone, or may be used in combination of two or more kinds in admixture. For example, either of the compounds represented by the above-mentioned formulae (3) to (5) may be used alone, or two or more kinds may be used in combination. In addition, all the compounds represented by the above-mentioned formulae (3) to (5) may be used in admixture.

In the present invention, the bicyclic liquid crystal compound represented by the formula (1) may be used alone, or may be used in combination of two or more kinds in admixture. For example, either of the compounds represented by the above-mentioned formulae (6) to (8) may be used alone, or two or more kinds may be used in combination. In addition, all the compounds represented by the above-mentioned formulae (6) to (8) may be used in admixture.

Preparation methods of the bicyclic liquid crystal compound represented by the formula (1) and the tricyclic liquid crystal compound represented by the formula (2) are not particularly limited, and these can be prepared by combining the known reactions. For example, these can be prepared in accordance with the method described in JP 2017-105874A.

The lubricant composition according to the present invention is extremely difficult to evaporate (for example, the remaining ratio in an atmosphere at a temperature of 100° C. after lapse of 600 hours is 95% or more), so that it has the advantage that it can be used continuously without replenishing for a long period of time as compared with general purpose grease and the like.

The lubricant composition according to the present invention is extremely difficult to evaporate under high vacuum (for example, the remaining ratio in an atmosphere at a temperature of 25° C. and a pressure of $10^{-5}$ Pa after lapse of 1,000 hours is 95% or more), so that it can be suitably used under high vacuum such as in outer space and the like.

The lubricant composition according to the present invention has extremely low dusting characteristics, so that it can be suitably used, for example, in a semiconductor manufacturing apparatus installed in a clean room where high cleanliness is required.

The lubricant composition according to the present invention is difficult to evaporate and has low dusting characteristics. Also, the lubricant composition according to the present invention can stably exhibit its performance under high vacuum or high temperature. Therefore, the lubricant composition according to the present invention can exhibit excellent performance as a lubricant for bearings.

The bearing in which the lubricant composition according to the present invention is sealed can be suitably used, for example, in a semiconductor manufacturing apparatus installed in a clean room. Also, the bearing in which the lubricant composition according to the present invention is sealed can be suitably used for a machine or an apparatus installed under a high vacuum such as outer space and the like. Further, the bearing in which the lubricant composition according to the present invention is sealed can be suitably used for precision machinery, wind power generators that are difficult in maintenance, seismic isolation devices, and the like.

Further, specific examples of the bearing in which the lubricant composition according to the present invention is sealed are bearings used in automobile electrical components such as electric fan motors and wiper motors, rolling bearings used in automobile engine accessories such as water pumps, electromagnetic clutch devices and the like and drive systems, rolling bearings used in rotating devices such as small to large general-purpose motors for industrial mechanical apparatuses, high-speed and high-precision rolling bearings such as spindle bearings for machine tools, rolling bearings used in motors and rotating devices for household appliances such as air conditioner fan motors and washing machines, rolling bearings used for rotating parts of computer-related equipment such as HDD devices, DVD devices and the like, rolling bearings used for rotating parts of office machines such as copying machines, automatic ticket gates and the like, and axial bearings of electric trains and freight cars.

Other components that the lubricant composition of the present invention may contain as long as the effects of the present invention are not impaired will be explained in order. These are basically conventionally known substances as components contained in the lubricant, and the contents thereof can be appropriately selected by those skilled in the art within the range of conventionally known unless otherwise specifically mentioned. Also, any of the components may be used alone or in combination of two or more kinds.

(Liquid Crystal Compound)

The compounds represented by the formulae (1) and (2) are liquid crystal compounds, and the lubricant composition of the present invention may contain liquid crystal compound(s) other than these.

Examples of such a liquid crystal compound are a liquid crystal compound showing a smectic phase or a nematic phase, an alkylsulfonic acid, a compound having a Nafion film-based structure, an alkylcarboxylic acid, an alkylsulfonic acid, and the like. In addition, the lubricant composition of the present invention may contain the liquid crystal compound(s) described in JP Patent No. 5,916,916 or JP 2017-105874A.

(Base Oil)

The lubricant composition of the present invention may be used in admixture of conventionally known various lubricant base oils.

Examples of the base oil are not particularly limited, and are mineral oil, highly refined mineral oil, synthetic hydrocarbon oil, paraffinic mineral oil, alkyldiphenyl ether oil, ester oil, silicone oil, naphthenic mineral oil, fluorine oil and the like.

(Other Additives)

Other additives which can be added to the lubricant composition of the present invention are various kinds of additives that are used for lubricants such as bearing oil, gear oil, hydraulic oil, and the like, that is, extreme pressure agents, orientation adsorbents, wear preventing agents, wear adjusting agents, oily agents, antioxidants, viscosity index improvers, pour point depressants, detergent dispersants, metal inactivators, corrosion inhibitors, rust preventive agents, defoaming agents, solid lubricants, and the like.

Examples of the above-mentioned extreme pressure agents are chlorine-based compounds, sulfur-based compounds, phosphoric acid-based compounds, hydroxycarboxylic acid derivatives and organic metal-based extreme pressure agents. By adding the extreme pressure agent, wear resistance of the electrically-conductive lubricant of the present invention is improved.

Examples of the above-mentioned orientation adsorbents are organic silane, organic titanium, organic aluminum and the like represented by various kinds of coupling agents such as silane coupling agents, titanium coupling agents, aluminum coupling agents and the like. By adding the orientation adsorbent, liquid crystal orientation of the liquid crystal compound contained in the lubricant composition of the present invention is strengthened, and the thickness and strength of the coating film formed from the lubricant composition of the present invention can be strengthened.

The lubricant composition of the present invention can be prepared by mixing the compounds represented by the formulae (1) and (2) and other components explained above by a conventionally known method. An example of the method for preparing the lubricant composition of the present invention is shown as follows.

The constitutional components of the lubricant composition are mixed by a conventional method, and thereafter, if necessary, roll milling, defoaming treatment, filter treatment, and the like, are carried out to obtain the lubricant composition of the present invention. Or else, the oil component of the lubricant composition may be previously mixed, subsequently other components such as additives, and the like are added and mixed, and if necessary, the above-mentioned defoaming treatment, and the like, is carried out to prepare the lubricant composition.

Examples

Hereinafter, more specific examples of the present invention will be explained, but the present invention is not limited thereto.

[Preparation of Lubricant Composition]

As a bicyclic liquid crystal compound, a mixture of compounds represented by the following formulae (6) to (8) was prepared. A mixing ratio of the compounds represented by the formulae (6) to (8) is approximately 1:2:1 (molar ratio).

[Formula 27]

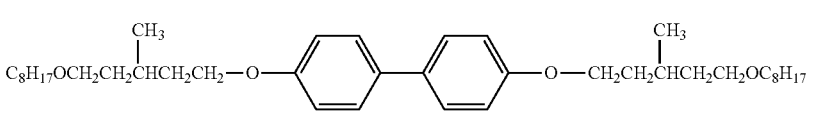

(6)

-continued

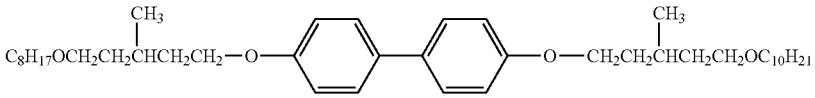

(7)

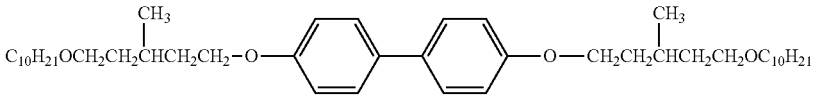

(8)

As a tricyclic liquid crystal compound, a mixture of compounds represented by the following formulae (3) to (5) was prepared. A mixing ratio of the compounds represented by the formulae (3) to (5) is approximately 1:2:1 (molar ratio).

[Formula 28]

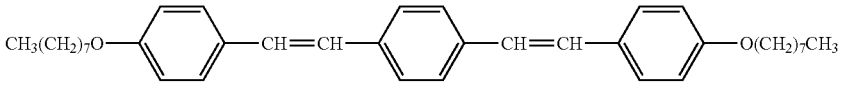

(3)

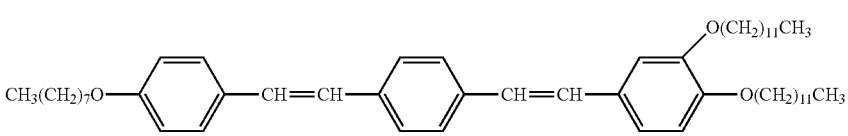

(4)

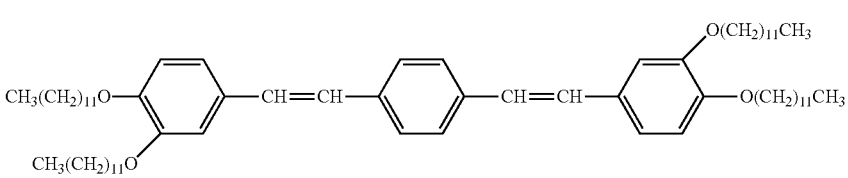

(5)

By heating the bicyclic liquid crystal compound and the tricyclic liquid crystal compound prepared as mentioned above to 200° C. and mixing them with various ratios, lubricant compositions were prepared. Using the prepared lubricant compositions, the tests explained below were carried out.

[Softness Test at Normal Temperature]

After cooling the lubricant composition to normal temperature (25° C.), it was stirred with a spatula several times and the test of sealing in a bearing was carried out. For the test, ball spline bearings were used.

Figure 4:
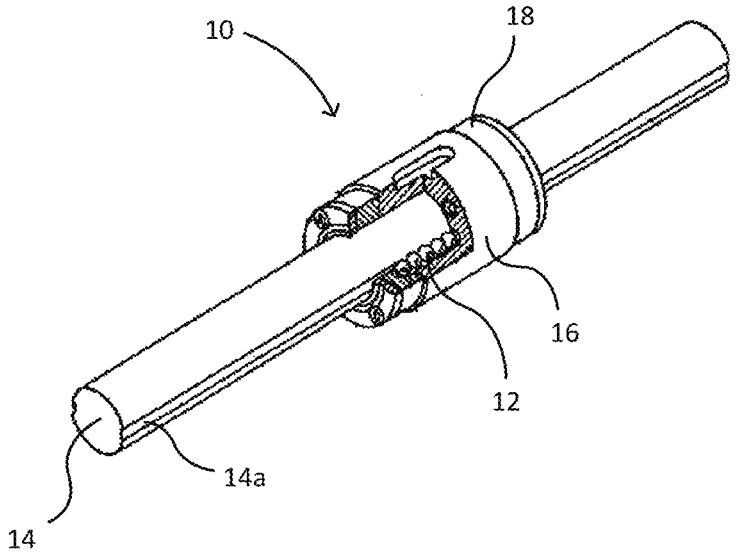
FIG. 4 is a perspective view of a bearing.

The ball spline bearing is, for example, as shown in FIG. 4, a small ball spline bearing 10 having an outer cylinder 16 that can move linearly along a shaft 14 through a plurality of rolling elements 12. On the outer peripheral surface of the shaft 14, a raceway groove 14*a* on which a plurality of rolling elements 12 being rolled is formed along the axial direction. The plurality of rolling elements 12 are held between the raceway grooves 14*a* formed on the outer peripheral surface of the shaft 14 and the inner surface of the outer cylinder 16. At the end portion of the outer cylinder 16, an end cap 18 for changing the direction of the plurality of rolling elements 12 is fixed by screwing or the like. The plurality of rolling elements 12 being rolled along the raceway grooves 14*a* are so configured that they are infinitely circulated by changing their direction in a direction-changing path formed in the end cap 18.

When the lubricant composition was sealed in the bearing 10, after the shaft 14 was pulled out from the outer cylinder 16, the lubricant composition was coated onto a plurality of rolling elements 12 held inside the outer cylinder 16. After coating the lubricant composition onto the plurality of rolling elements 12, as shown in FIG. 4, the outer cylinder 16 was assembled again on the shaft 14.

Then, the lubricant composition was sealed in the bearing 10, and the softness of the lubricant composition at normal temperature was judged based on whether the rolling element could circulate or not. The judgment criteria are as follows. Incidentally, for the test, a small ball spline bearing ("LSAG4" manufactured by Nippon Thompson Co., Ltd.) having a diameter of the shaft of 4 mm was used.

A: The rolling elements are possible to circulate, and the lubricant composition remarkably has flexibility.

B: The rolling elements are possible to circulate, and the lubricant composition has flexibility.

C: The rolling elements are impossible to circulate, the lubricant composition has no flexibility and easily crushable.

In the following Table 1, the mixing ratio of the bicyclic liquid crystal compound and the tricyclic liquid crystal compound contained in the lubricant composition and the results of the softness test of the lubricant composition at normal temperature are shown.

TABLE 1

| Softness test result at normal temperature | | |
|---|---|---|
| Mixing ratio (mass ratio) | | |
| Bicyclic liquid crystal compound | Tricyclic liquid crystal compound | Judgment |
| 100 | 0 | A |
| 80 | 20 | A |
| 70 | 30 | A |
| 60 | 40 | B |
| 50 | 50 | B |
| 40 | 60 | B |
| 30 | 70 | B |
| 20 | 80 | B |
| 10 | 90 | C |
| 0 | 100 | C |

From the results shown in Table 1, it was found that the softness of the lubricant composition tends to be improved when the bicyclic liquid crystal compound is contained in a larger amount than the tricyclic liquid crystal compound. In particular, when the mixing ratio of the bicyclic liquid crystal compound is 70 or more (provided that the total of the bicyclic liquid crystal compound and the tricyclic liquid crystal compound is made 100), the lubricant composition has sufficient softness, and it was easy to seal the lubricant composition in the bearing. On the contrary, when the mixing ratio of the bicyclic liquid crystal compound was 10 or less, the lubricant composition became hard, so that the rolling element could not circulate in the bearing.

[Fluidity Test at the Time of Heating]

Figure 5:
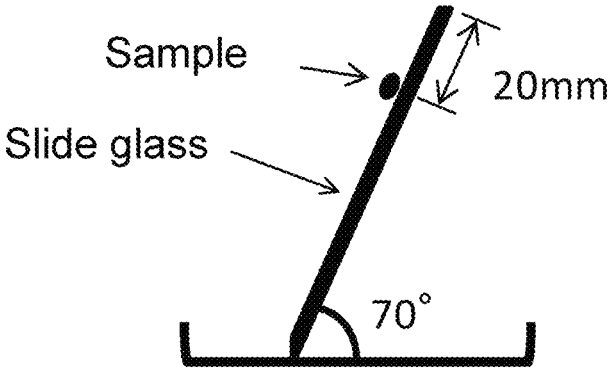
FIG. 5 is a schematic view of an apparatus used for the fluidity test.

A test for confirming fluidity when the lubricant composition was heated was carried out. The device used for the test is shown in FIG. 5.

In the test, first, the lubricant composition (about 5 mg) was adhered on the slide glass. The inclination angle of the slide glass was set to 70°. The lubricant composition was attached at a position 20 mm from the upper end of the slide glass. After adhering the lubricant composition onto the slide glass, the slide glass was heated in an oven until it reached a predetermined temperature. After leaving the heated slide glass for 10 minutes, the fluidity of the lubricant composition was judged by visually observing the lubricant composition adhered onto the slide glass. The judgment criteria are as follows.

○: The lubricant composition does not drip on the slide glass.

x: The lubricant composition is dripping on the slide glass.

In the following Table 2 and Table 3, the mixing ratio (mass ratio) of the bicyclic liquid crystal compound and the tricyclic liquid crystal compound contained in the lubricant composition, and the results of the fluidity test of the lubricant composition at the time of heating are shown. Sample Nos. in Table 2 correspond to Sample Nos. in Table 3.

TABLE 2

| Sample No. | ① | ② | ③ | ④ | ⑤ | ⑥ | ⑦ | ⑧ | ⑨ | ⑩ | ⑪ | ⑫ |
|---|---|---|---|---|---|---|---|---|---|---|---|---|
| Bicyclic liquid crystal compound | 100 | 80 | 70 | 60 | 50 | 40 | 30 | 25 | 20 | 10 | 4 | 0 |
| Tricyclic liquid crystal compound | 0 | 20 | 30 | 40 | 50 | 60 | 70 | 75 | 80 | 90 | 96 | 100 |

TABLE 3

| Heating temperature | Sample No. | | | | | | | | | | | |
|---|---|---|---|---|---|---|---|---|---|---|---|---|
| (° C.) | ① | ② | ③ | ④ | ⑤ | ⑥ | ⑦ | ⑧ | ⑨ | ⑩ | ⑪ | ⑫ |
| 25 | ○ | ○ | ○ | ○ | ○ | ○ | ○ | ○ | ○ | ○ | ○ | ○ |
| 30 | X | ○ | ○ | ○ | ○ | ○ | ○ | ○ | ○ | ○ | ○ | ○ |
| 40 | X | ○ | ○ | ○ | ○ | ○ | ○ | ○ | ○ | ○ | ○ | ○ |
| 50 | X | ○ | ○ | ○ | ○ | ○ | ○ | ○ | ○ | ○ | ○ | ○ |
| 55 | X | ○ | ○ | ○ | ○ | ○ | ○ | ○ | ○ | ○ | ○ | ○ |
| 60 | X | ○ | ○ | ○ | ○ | ○ | ○ | ○ | ○ | ○ | ○ | ○ |
| 80 | X | ○ | ○ | ○ | ○ | ○ | ○ | ○ | ○ | ○ | ○ | ○ |
| 90 | X | ○ | ○ | ○ | ○ | ○ | ○ | ○ | ○ | ○ | ○ | ○ |
| 100 | X | ○ | ○ | ○ | ○ | ○ | ○ | ○ | ○ | ○ | ○ | ○ |
| 110 | X | ○ | ○ | ○ | ○ | ○ | ○ | ○ | ○ | ○ | ○ | ○ |
| 115 | X | X | ○ | ○ | ○ | ○ | ○ | ○ | ○ | ○ | ○ | ○ |
| 120 | X | X | ○ | ○ | ○ | ○ | ○ | ○ | ○ | ○ | ○ | ○ |
| 125 | X | X | X | ○ | ○ | ○ | ○ | ○ | ○ | ○ | ○ | ○ |
| 130 | X | X | X | X | ○ | ○ | ○ | ○ | ○ | ○ | ○ | ○ |
| 135 | X | X | X | X | X | ○ | ○ | ○ | ○ | ○ | ○ | ○ |
| 140 | X | X | X | X | X | ○ | ○ | ○ | ○ | ○ | ○ | ○ |
| 145 | X | X | X | X | X | X | ○ | ○ | ○ | ○ | ○ | ○ |
| 150 | X | X | X | X | X | X | X | X | ○ | ○ | ○ | ○ |
| 155 | X | X | X | X | X | X | X | X | X | ○ | ○ | ○ |
| 160 | X | X | X | X | X | X | X | X | X | X | ○ | ○ |
| 165 | X | X | X | X | X | X | X | X | X | X | X | ○ |
| 170 | X | X | X | X | X | X | X | X | X | X | X | X |
| 175 | X | X | X | X | X | X | X | X | X | X | X | X |
| 180 | X | X | X | X | X | X | X | X | X | X | X | X |
| 185 | X | X | X | X | X | X | X | X | X | X | X | X |
| 190 | X | X | X | X | X | X | X | X | X | X | X | X |
| 195 | X | X | X | X | X | X | X | X | X | X | X | X |
| 200 | X | X | X | X | X | X | X | X | X | X | X | X |

From the results shown in Table 2 and Table 3, when the mixing ratio of the tricyclic liquid crystal compound is 20 or more (provided that the total of the bicyclic liquid crystal compound and the tricyclic liquid crystal compound is made 100), it was found that dripping of the lubricant composition does not occur even when the slide glass is heated to 110° C. Therefore, for example, in order to obtain a lubricant composition in which dripping does not occur even at a high temperature (about 100° C.) during baking of a vacuum apparatus, it was found that the mixing ratio of the tricyclic liquid crystal compound was preferably 20 or more.

[Durability Test Under High Temperature]

A test was carried out in which the lubricant composition was sealed in the bearing 10 shown in FIG. 4, and the shaft 14 was continuously reciprocated while the outer cylinder 16 is in the state of fixed while being heated. When the vibration value of the bearing 10 under the test exceeded the set value, or at the time of confirming abnormal occurrence of wear powder, the test was stopped and the mileage at that time was measured. Other test conditions are as follows. Also, as Comparative Example, a commercially available cyclopentane-based lubricant for vacuum and a fluorine-based lubricant for vacuum were each sealed in the bearing, and the same test was carried out. The results of these tests are shown in the following Table 4.

(Test Conditions)
Heating temperature of outer cylinder: 80° C.
Load: Medium precompression
Stroke: 50 mm
Maximum speed: 1 m/s
Sealed amount of lubricant composition: 3 mg

TABLE 4

| Mixing ratio (mass ratio) of bicyclic liquid crystal compound and tricyclic liquid crystal compound | Running distance (km) |
|---|---|
| 100:0 | 207 |
| 80:20 | 694 |
| 70:30 | 347 |
| 60:40 | 251 |
| 40:60 | 112 |
| 10:90 | Lubricant composition was powder state at normal temperature and had low softness so that test could not be done. |
| 0:100 | Lubricant composition was powder state at normal temperature and had low softness so that test could not be done. |
| Cyclopentane-based lubricant for vacuum | 220 |
| Fluorine-based lubricant for vacuum | 147 |

From the results shown in Table 4, it was found that durability of the lubricant composition under high temperature was improved when the bicyclic liquid crystal compound was more contained than that of the tricyclic liquid crystal compound. In particular, when the mixing ratio of the bicyclic liquid crystal compound and the tricyclic liquid crystal compound was 80:20 to 60:40, it was found that durability of the lubricant composition under high temperature was remarkably high. Also, when the mixing ratio of the bicyclic liquid crystal compound was 40 or more (provided that the total of the bicyclic liquid crystal compound and the tricyclic liquid crystal compound is made 100), it was found that a lubricant composition having durability under high temperature which was equal to or higher than a commercially available lubricant for vacuum could be obtained.

[Evaporation Test Under High Temperature]

A lubricant composition having a mixing ratio (mass ratio) of the bicyclic liquid crystal compound and the tricyclic liquid crystal compound of 6:4 was prepared. The prepared lubricant composition was allowed to stand in an environment of 100° C. and atmospheric pressure for 770 hours, and the remaining ratio of the lubricant composition was measured by the following equation.

Remaining rate (%)=(Residual amount of lubricant composition (g)/Initial amount of lubricant composition (g))×100

Also, as Comparative Example, the same test was carried out using a commercially available cyclopentane-based lubricant for vacuum and a fluorine-based lubricant for vacuum. These measurement results are shown in the following Table 5.

TABLE 5

| Lapsed time (hr) | 0 | 20 | 120 | 300 | 500 | 770 |
|---|---|---|---|---|---|---|
| Lubricant composition (mixing ratio 6:4) | 100% | 100% | 100% | 100% | 100% | 100% |
| Fluorine-based lubricant for vacuum | 100% | 100% | 100% | 100% | 100% | 100% |

TABLE 5-continued

| Lapsed time (hr) | 0 | 20 | 120 | 300 | 500 | 770 |
|---|---|---|---|---|---|---|
| Cyclopentane-based lubricant for vacuum | 100% | 98% | 96% | 94% | 93% | 92% |

From the results shown in Table 5, it was confirmed that the lubricant composition of the present invention had a remaining ratio after lapse of 770 hours of 100% and hardly evaporated even at a high temperature of 100° C. On the other hand, the remaining ratio of the cyclopentane-based lubricant for vacuum after lapse of 770 hours was 92%, and 8% thereof was lost by evaporation. From these results, it could be confirmed that the lubricant composition of the present invention was extremely difficult to evaporate, so that it could be continuously used without being replenished for a long period of time as compared with general-purpose grease and the like.

[Evaporation Test Under Vacuum Environment]

A lubricant composition having a mixing ratio of a bicyclic liquid crystal compound and a tricyclic liquid crystal compound of 6:4 (mass ratio) was prepared. The prepared lubricant composition was allowed to stand at 23° C. under a highly vacuum atmosphere of $4.0\times10^{-5}$ Pa for 1,092 hours, and the remaining ratio (%) of the lubricant composition was measured according to the above-mentioned equation. The measurement results are shown in the following Table 6.

TABLE 6

| Lapsed time (hr) | 0 | 18 | 48 | 114 | 138 | 162 | 186 | 258 | 282 |
|---|---|---|---|---|---|---|---|---|---|
| Remaining ratio (%) | 100 | 100 | 100 | 100 | 100 | 100 | 100 | 100 | 100 |
| Lapsed time (hr) | 306 | 330 | 420 | 468 | 600 | 804 | 948 | 1092 | |
| Remaining ratio (%) | 100 | 100 | 100 | 100 | 100 | 100 | 100 | 100 | |

From the results shown in Table 6, it could be confirmed that the lubricant composition of the present invention had a remaining ratio after lapse of 1,092 hours of 100%, and it was extremely difficult to evaporate under a high vacuum atmosphere.

From this result, it could be confirmed that the lubricant composition of the present invention is hardly evaporated under a high vacuum, so that it could stably exhibit its characteristics under a high vacuum such as outer space and the like.

[Saturated Vapor Pressure Measurement Test]

A lubricant composition in which the mixing ratio of the bicyclic liquid crystal compound and the tricyclic liquid crystal compound of 6:4 (mass ratio) was prepared. The changes in the saturated vapor pressure and mass of the prepared lubricant composition were measured using a saturated vapor pressure evaluation device (VPE-9000 manufactured by ULVAC Inc.). The measurement conditions are as follows.

(Measurement Conditions)
Collected amount: 20 mg
Vacuum degree: 0.0012 Pa
Temperature raising speed: 2° C./min
Evaporation starting temperature: Temperature at the time at which 1% of the mass decreased Also, as Comparative Example, the same measurement was carried out using a commercially available cyclopentane-based lubricant for vacuum. These measurement results are shown in FIG. 6.

Figure 6:
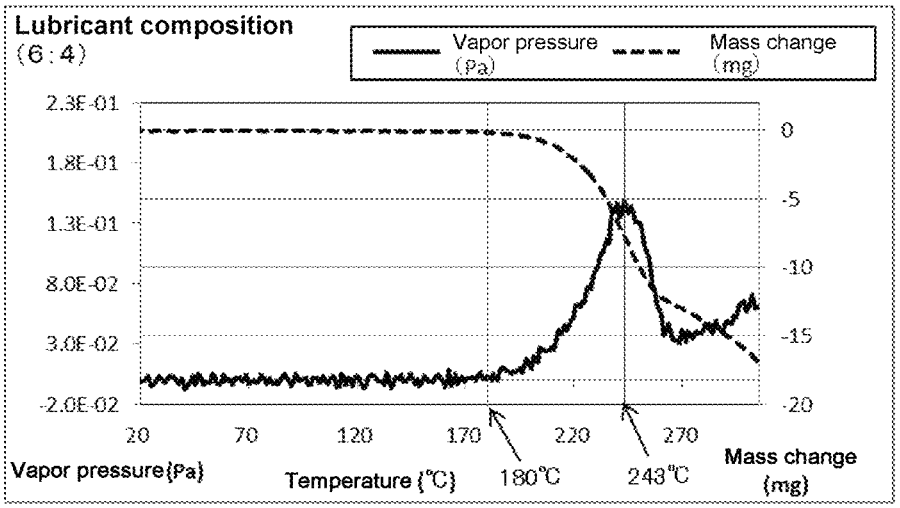
FIG. 6 is a graph showing the result of the saturated vapor pressure measurement test.
Figure 6:
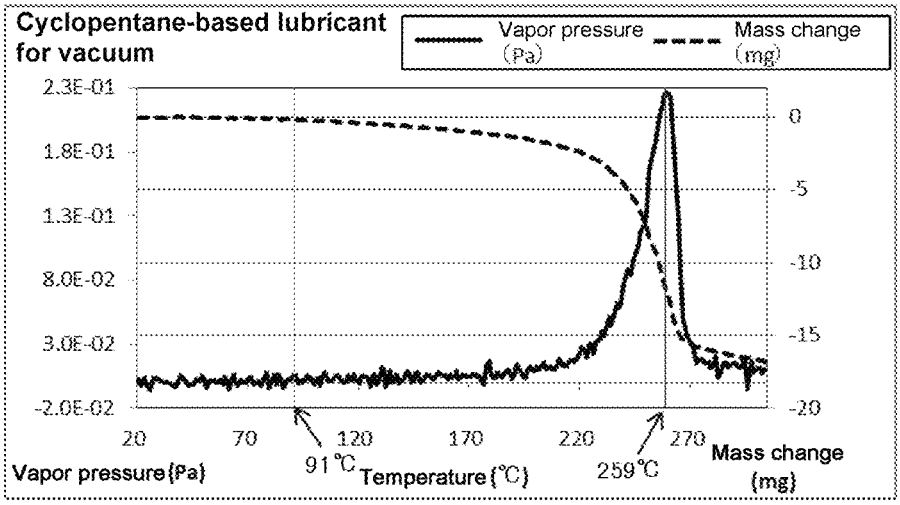

As shown in FIG. 6, the evaporation start temperature of the lubricant composition of the present invention was 180° C., and the saturated vapor pressure (maximum vapor pressure) at 243° C. was $1.49\times10^{-1}$ Pa. To the contrary, the evaporation start temperature of the cyclopentane-based lubricant for vacuum was 91° C., the saturated vapor pressure (maximum vapor pressure) at 259° C. was $2.26\times10^{-1}$ Pa. From this result, it could be confirmed that the lubricant composition of the present invention is more resistant to evaporation than the commercially available lubricant for vacuum.

[Pressure Measurement Test at the Time of Temperature Raising]

A lubricant composition in which a mixing ratio of the bicyclic liquid crystal compound and the tricyclic liquid crystal compound was 6:4 (mass ratio) was prepared. The pressure change (total pressure) when the prepared lubricant composition was heated was measured using a saturated vapor pressure evaluation device (VPE-9000 manufactured by ULVAC Inc.). The measurement conditions are as follows.

(Measurement Conditions)

Measurement temperature: Room temperature to 200° C.

Temperature raising speed: 10° C./min

Pressure at the time of starting measurement: about $1.0\times10^{-5}$ Pa

Also, as Comparative Example, the same measurement was carried out using a commercially available cyclopentane-based lubricant for vacuum and a fluorine-based lubricant for vacuum. These measurement results are shown in FIG. 7.

Figure 7:
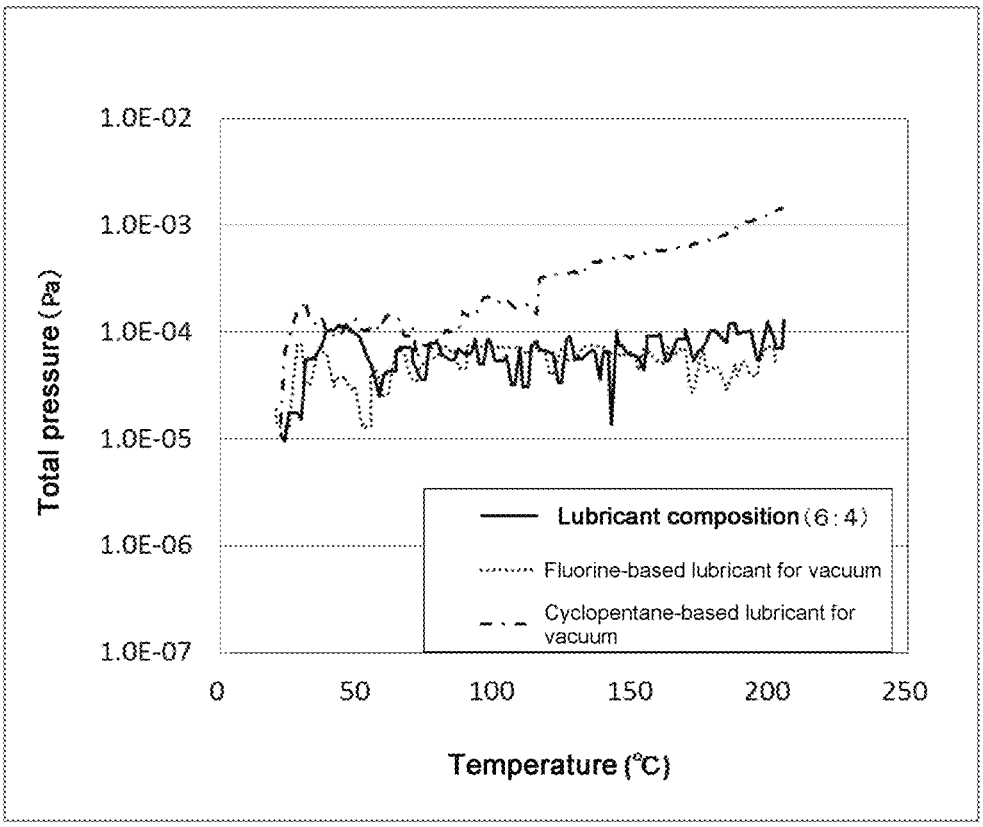
FIG. 7 is a graph showing the result of the pressure measurement test at the time of raising temperature.

As shown in FIG. 7, the total pressure of the lubricant composition of the present invention did not almost change up to around 200° C. To the contrary, it could be confirmed that the total pressure of the cyclopentane-based lubricant for vacuum rapidly rose at about 90° C. and easily evaporated. From these results, it could be confirmed that the lubricant composition of the present invention was extremely resistant to evaporation as compared with a commercially available cyclopentane-based lubricant for vacuum, and the total pressure was stable at room temperature to 200° C.

[Dusting Characteristics Test]

A test for evaluating dusting characteristics of the lubricant composition was carried out by continuously operating a linear motion guide unit in which the lubricant composition has been sealed. The linear motion guide unit used in the test is shown in FIG. 8.

Figure 8:
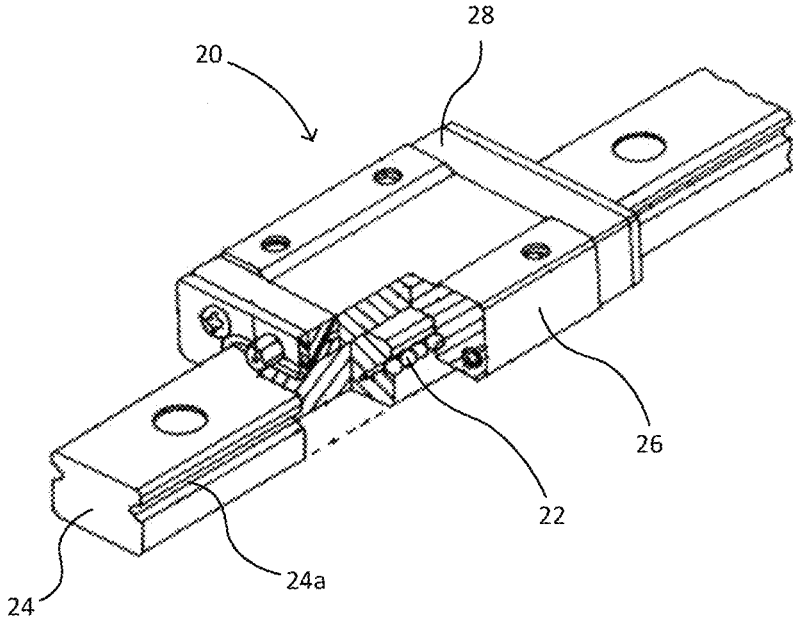
FIG. 8 is a perspective view of a linear motion guide unit.

As shown in FIG. 8, a linear motion guide unit 20 is a small linear motion guide unit ("LWL9" manufactured by Nippon Thompson Co., Ltd.) having a slider 26 that can move linearly along a track rail 24 through a plurality of rolling elements 22. On both side surfaces of the track rail 24, raceway grooves 24*a* on which a plurality of rolling elements 22 being rolled is formed along the longitudinal direction. The plurality of rolling elements 22 are held between the raceway grooves 24*a* formed on both side surfaces of the track rail 24 and the inner surface of the slider 26. At the end portion of the slider 26, an end cap 28 for changing the direction of the plurality of rolling elements 22 is fixed by screwing or the like. The plurality of rolling elements 22 being rolled along the raceway grooves 24*a* are so configured that they are infinitely circulated by changing their direction in a direction-changing path formed in the end cap 28.

In the test, first, a lubricant composition having a mixing ratio of the bicyclic liquid crystal compound and the tricyclic liquid crystal compound of 6:4 (mass ratio) and a lubricant composition having a mixing ratio of the bicyclic liquid crystal compound and the tricyclic liquid crystal compound of 8:2 (mass ratio) was prepared. The prepared lubricant compositions were each sealed in the linear motion guide unit 20. When the lubricant composition was sealed in the linear motion guide unit 20, after the track rail 24 was pulled out from the slider 26, the lubricant composition was coated onto a plurality of rolling elements 22 held inside the slider 26. After coating the lubricant composition onto the plurality of rolling elements 22, as shown in FIG. 8, the slider 26 was assembled again on the track rail 24.

Next, the linear motion guide unit 20 in which the lubricant composition has been sealed was continuously reciprocated in the chamber. During operating the linear motion guide unit 20, clean air that has passed through a HEPA filter was sent into the chamber by a downflow method, and the number of particles in the exhaust gas discharged from the chamber was measured by each particle diameter range shown in the following Table 7. For the measurement of the number of particles, a particle counter (KC-22A, manufactured by Rion Co., Ltd.) was used. Other measurement conditions are as follows.

(Measurement Conditions)

Moving distance of linear motion guide unit: 500 mm

Maximum speed: 1 m/s

Load: 80N

Air volume (sampling air volume): 0.38 $m^3$/min

Measurement time: 24 hours

In addition, as Comparative Example, a commercially available cyclopentane-based lubricant for vacuum and a hydrocarbon-based lubricant for low-dusting were each sealed in the linear motion guide unit 20, and the same test was carried out. The results of these tests are shown in the following Table 7 and FIG. 9.

TABLE 7

| | Average dusting amount (particles/$m^3$) per each particle diameter (μm) range | | | | |
|---|---|---|---|---|---|
| | 0.10-0.15 | 0.15-0.20 | 0.20-0.30 | 0.30-0.50 | 0.5 or more |
| Lubricant composition (6:4) | 1965 | 1131 | 1354 | 2217 | 4827 |
| Lubricant composition (8:2) | 25722 | 15590 | 20301 | 18783 | 79016 |
| Cyclopentane-based lubricant for vacuum | 3767 | 8904 | 10081 | 19297 | 88775 |
| Hydrocarbon-based lubricant for low-dusting | 1014 | 1450 | 1899 | 2315 | 3626 |

Figure 9:
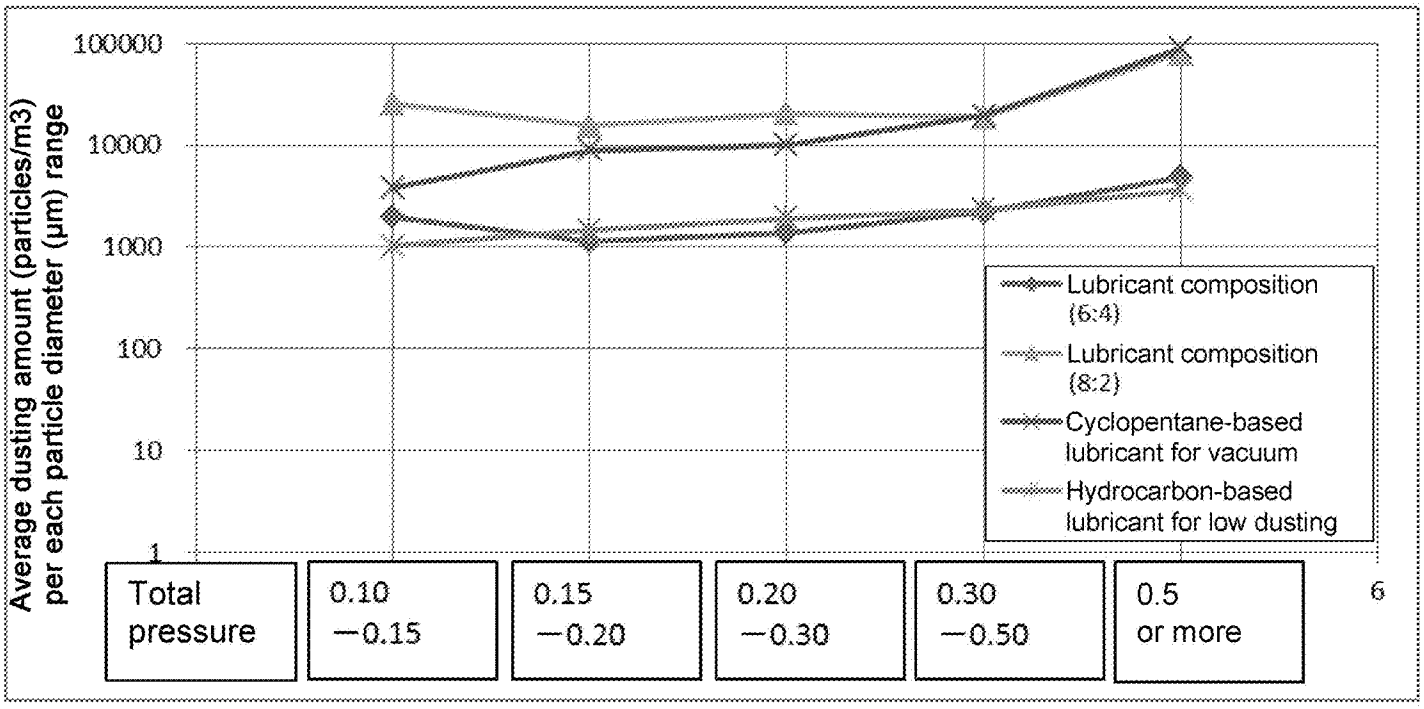
FIG. 9 is a graph showing the result of the dusting characteristics test.

From the results shown in Table 7 and FIG. 9, it could be confirmed that the dusting amount of the lubricant composition of the present invention was extremely little, and even when it is compared with a commercially available cyclopentane-based lubricant for vacuum or a hydrocarbon-based lubricant for low-dusting, dusting characteristics was sufficiently low. Also, it could be confirmed that the lubricant composition (6:4) in which the bicyclic liquid crystal compound is less contained had lower dusting characteristics.

The mixing ratio of the bicyclic liquid crystal compound and the tricyclic liquid crystal compound of the lubricant composition of the present invention is 95:5 to 15:85 in a mass ratio. The lubricant composition of the present invention preferably contains more bicyclic liquid crystal compounds than tricyclic liquid crystal compounds. The mixing ratio of the bicyclic liquid crystal compound and the tricyclic liquid crystal compound can be made more preferably 80:20 to 60:40.

EXPLANATION OF REFERENCE NUMERALS

10 Bearing

12 Rolling element

14 Shaft

16 Outer cylinder

18 End cap

20 Linear motion guide unit

22 Rolling element

24 Track rail

26 Slider

28 End cap

The present inventors have found a liquid crystal mixture which can exhibit excellent properties as a lubricant by mixing a bicyclic liquid crystal compound and a tricyclic liquid crystal compound having specific structures, and completed the present invention. That is, the present invention includes the following.

[1]

A lubricant composition which comprises at least one kind of a bicyclic liquid crystal compound represented by the following formula (1), at least one kind of a tricyclic liquid crystal compound represented by the following formula (2), and at least one kind of a tricyclic liquid crystal compound represented by the following formula (3).

Formula (1):

[Formula 29]

(1)

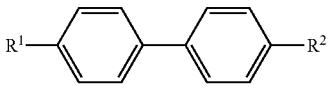

[wherein, $R^1$ and $R^2$ are the same or different from each other, and each is a group —$OCH_2CH_2CH(R')CH_2CH_2OR$ (R is a linear or branched $C_nH_{2n+1}$, $1 \leq n \leq 20$, and R' is methyl or ethyl)]

Formula (2):

[Formula 30]

(2)

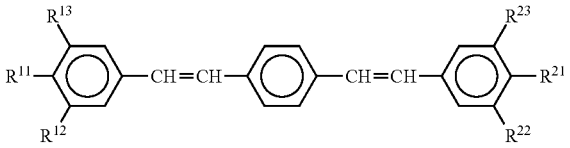

[wherein, $R^{11}$ and $R^{21}$ are the same or different from each other, and each is a group —OR (R is a linear or branched $C_nH_{2n+1}$, and $1 \leq n \leq 20$), $R^{12}$, $R^{13}$, $R^{22}$ and $R^{23}$ are the same or different from each other, and each is hydrogen or a group —OR (R is a linear or branched $C_nH_{2n+1}$, and $1 \leq n \leq 20$)]

Formula (3):

[Formula 31]

(3)

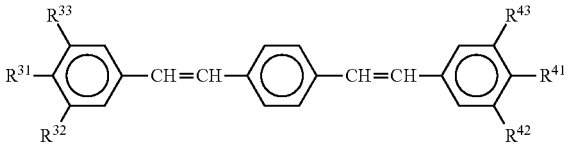

[wherein, $R^{31}$ and $R^{41}$ are the same or different from each other, and each is a group —$OCH_2CH_2CH(R')CH_2CH_2OR$ (R is a linear or branched $C_nH_{2n+1}$, $1 \leq n \leq 20$, and R' is methyl or ethyl), $R^{32}$, $R^{33}$, $R^{42}$, and $R^{43}$ are the same or different from each other, and each is hydrogen or a group —$OCH_2CH_2CH(R')CH_2CH_2OR$ (R is a linear or branched $C_nH_{2n+1}$, $1 \leq n \leq 20$, and R' is methyl or ethyl)]

[2] The lubricant composition described in [1], wherein $1 \leq n \leq 15$ and R' is methyl in the formula (1).

[3] The lubricant composition described in [1] or [2], wherein $R^{32}$ or $R^{33}$, and $R^{42}$ or $R^{43}$ is a group —$OCH_2CH_2CH(R')CH_2CH_2OR$ (R is a linear $C_nH_{2n+1}$, $1 \leq n \leq 15$, and R' is methyl) in the formula (3).

[4] The lubricant composition described in any of [1] to [3], wherein the tricyclic liquid crystal compound represented by the formula (2) is at least one kind among the compounds represented by the following formulae (4) to (6).

[Formula 32]

(4)

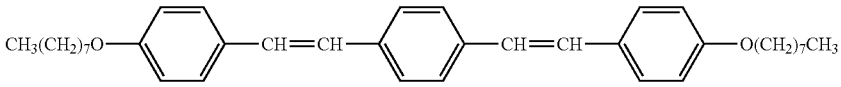

(5)

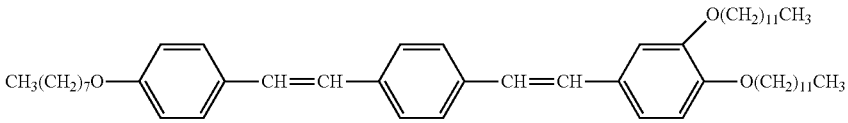

(6)

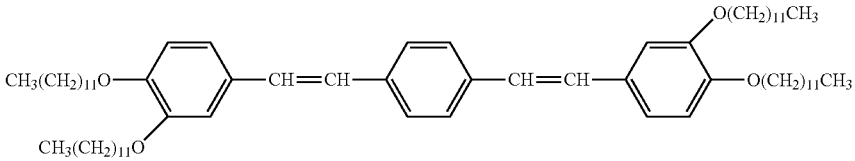

[5] The lubricant composition described in any of [1] to [4], wherein the tricyclic liquid crystal compound represented by the above formula (3) is at least one kind of the compounds represented by the following formulae (7) and (8).

[Formula 33]

(7)

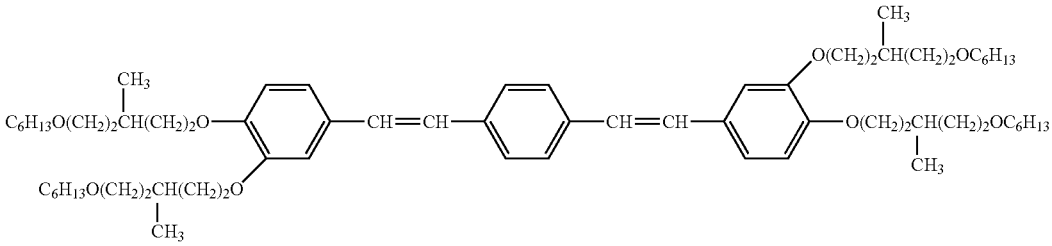

(8)

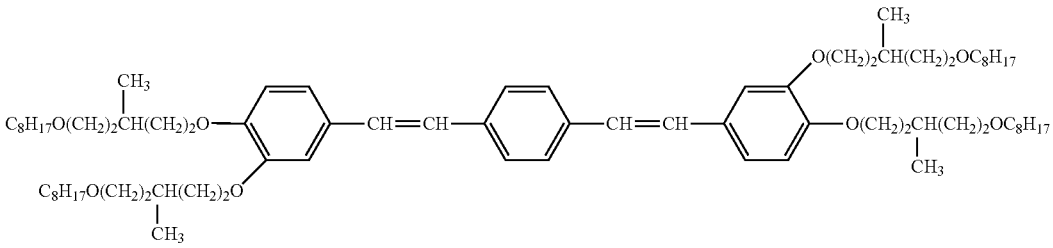

[6] The lubricant composition described in any of [1] to [5], wherein a mixing ratio of the bicyclic liquid crystal compound represented by the formula (1), and a total of the tricyclic liquid crystal compound represented by the formula (2) and the tricyclic liquid crystal compound represented by the formula (3) is 60:40 to 4:96 in a mass ratio.

[7] The lubricant composition described in any of [1] to [6], wherein the content of the bicyclic liquid crystal compound is 4 to 40 wt %, and the content of the tricyclic liquid crystal compound represented by the above formula (3) is 20 to 64 wt %.

[8] A bearing in which the lubricant composition described in any of [1] to [7] is sealed therein.

Effects of the Invention

According to the present invention, it is possible to provide a lubricant composition suitable for use in a clean environment, under a high vacuum or under high temperature, and a bearing in which the lubricant composition is sealed.

Embodiments to Carry Out the Invention

According to the present invention, it is provided a lubricant composition comprising at least one kind of a bicyclic liquid crystal compound represented by the following formula (1), at least one kind of a tricyclic liquid crystal compound represented by the following formula (2), and at least one kind of a tricyclic liquid crystal compound represented by the following formula (3).

Formula (1):

[Formula 34]

(1)

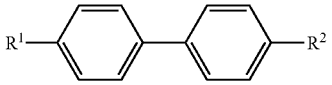

[wherein, $R^1$ and $R^2$ are the same or different from each other, and each is a group —$OCH_2CH_2CH(R')CH_2CH_2OR$ (R is a linear or branched $C_nH_{2n+1}$, $1 \leq n \leq 20$, and R' is methyl or ethyl)]

Formula (2):

[Formula 35]

(2)

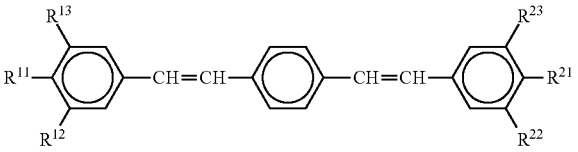

[wherein, $R^{11}$ and $R^{21}$ are the same or different from each other, and each is a group —OR (R is a linear or branched $C_nH_{2n+1}$, and $1 \leq n \leq 20$), $R^{12}$, $R^{13}$, $R^{22}$ and $R^{23}$ are the same or different from each other, and each is hydrogen or a group —OR (R is a linear or branched $C_nH_{2n+1}$, and $1 \leq n \leq 20$)]

Formula (3):

[Formula 36]

(3)

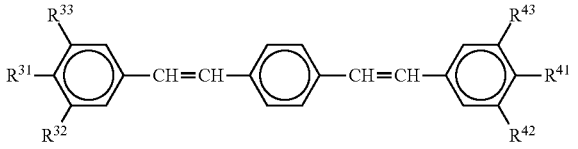

[wherein, $R^{31}$ and $R^{41}$ are the same or different from each other, and each is a group —$OCH_2CH_2CH(R')CH_2CH_2OR$ (R is a linear or branched $C_nH_{2n+1}$, $1 \leq n \leq 20$, and R' is methyl or ethyl), $R^{32}$, $R^{33}$, $R^{42}$, and $R^{43}$ are the same or different from each other, and each is hydrogen or a group —$OCH_2CH_2CH(R')CH_2CH_2OR$ (R is a linear or branched $C_nH_{2n+1}$, $1 \leq n \leq 20$, and R' is methyl or ethyl)]

In the formulae (1) to (3), $R^1$, $R^2$, $R^{11}$, $R^{12}$, $R^{13}$, $R^{21}$, $R^{22}$, $R^{23}$, $R^{31}$, $R^{32}$, $R^{33}$, $R^{41}$, $R^{42}$ and $R^{43}$ are linked to the core structure, and are chain groups responsible for lubricity of the molecule. By appropriately selecting $R^1$, $R^2$, $R^{11}$, $R^{12}$, $R^{13}$, $R^{21}$, $R^{22}$, $R^{23}$, $R^{31}$, $R^{32}$, $R^{33}$, $R^{41}$, $R^{42}$ and $R^{43}$, the size (long axis) and polarity of the whole molecule can be adjusted.

Examples of R in the formula (1) to (3) are an n-butyl group, an isobutyl group, a sec-butyl group, a tert-butyl group, an n-pentyl group, a 1-methyl-n-butyl group, a 2-methyl-n-butyl group, a 3-methyl-n-butyl group, a 1,1-dimethyl-n-propyl group, a 1,2-dimethyl-n-propyl group, a 2,2-dimethyl-n-propyl group, a 1-ethyl-n-propyl group, an n-hexyl group, a 1-methyl-n-pentyl group, a 2-methyl-n-pentyl group, a 3-methyl-n-pentyl group, a 4-methyl-n-pentyl group, a 1,1-dimethyl-n-butyl group, a 1,2-dimethyl-n-butyl group, a 1,3-dimethyl-n-butyl group, a 2,2-dimethyl-n-butyl group, a 2,3-dimethyl-n-butyl group, a 3,3-dimethyl-n-butyl group, a 1-ethyl-n-butyl group, a 2-ethyl-n-butyl group, a 1,1,2-trimethyl-n-propyl group, a 1,2,2-trimethyl-n-propyl group, a 1-ethyl-1-methyl-n-propyl group, a 1-ethyl-2-methyl-n-propyl group, an n-heptyl group, a 1-methyl-n-hexyl group, a 2-methyl-n-hexyl group, a 3-methyl-n-hexyl group, a 1,1-dimethyl-n-pentyl group, a 1,2-dimethyl-n-pentyl group, a 1,3-dimethyl-n-pentyl group, a 2,2-dimethyl-n-pentyl group, a 2,3-dimethyl-n-pentyl group, a 3,3-dimethyl-n-pentyl group, a 1-ethyl-n-pentyl group, a 2-ethyl-n-pentyl group, a 3-ethyl-n-pentyl group, a 1-methyl-1-ethyl-n-butyl group, a 1-methyl-2-ethyl-n-butyl group, a 1-ethyl-2-methyl-n-butyl group, a 2-methyl-2-ethyl-n-butyl group, a 2-ethyl-3-methyl-n-butyl group, an n-octyl group, a 1-methyl-n-heptyl group, a 2-methyl-n-heptyl group, a 3-methyl-n-heptyl group, a 1,1-dimethyl-n-hexyl group, a 1,2-dimethyl-n-hexyl group, a 1,3-dimethyl-n-hexyl group, a 2,2-dimethyl-n-hexyl group, a 2,3-dimethyl-n-hexyl group, a 3,3-dimethyl-n-hexyl group, a 1-ethyl-n-hexyl group, a 2-ethyl-n-hexyl group, a 3-ethyl-n-hexyl group, a 1-methyl-1-ethyl-n-pentyl group, a 1-methyl-2-ethyl-n-pentyl group, a 1-methyl-3-ethyl-n-pentyl group, a 2-methyl-2-ethyl-n-pentyl group, a 2-methyl-3-ethyl-n-pentyl group, a 3-methyl-3-ethyl-n-pentyl group, an n-nonyl group, an n-decyl group, an n-undecyl group, an n-dodecyl group and the like.

In the formula (1), $R^1$ and $R^2$ are the same or different from each other, and each is a group —$OCH_2CH_2CH(R')CH_2CH_2OR$ (R is a linear or branched $C_nH_{2n+1}$, $1 \leq n \leq 20$, preferably $1 \leq n \leq 15$, more preferably $4 \leq n \leq 12$, particularly preferably $8 \leq n \leq 10$, and R' is methyl or ethyl).

In the formula (1), it is preferably $1 \leq n \leq 15$, and R' is methyl.

In the formula (2), $R^{11}$ and $R^{21}$ are the same or different from each other, and each is a group —OR (R is a linear or branched $C_nH_{2n+1}$, $1 \leq n \leq 20$, preferably $4 \leq n \leq 16$, and more preferably $8 \leq n \leq 12$).

In the formula (2), $R^{12}$, $R^{13}$, $R^{22}$ and $R^{23}$ are the same or different from each other, and each is hydrogen or a group —OR (R is a linear or branched $C_nH_{2n+1}$, $1 \leq n \leq 20$, preferably $4 \leq n \leq 16$, and more preferably $8 \leq n \leq 12$).

In the formula (3), $R^{31}$ and $R^{41}$ are the same or different from each other, and each is a group —$OCH_2CH_2CH(R')CH_2CH_2OR$ (R is a linear or branched $C_nH_{2n+1}$, $1 \leq n \leq 20$, preferably $4 \leq n \leq 16$, more preferably $4 \leq n \leq 12$, particularly preferably $6 \leq n \leq 8$, and R' is methyl or ethyl).

In the formula (3), $R^{32}$, $R^{33}$, $R^{42}$ and $R^{43}$ are the same or different from each other, and each is hydrogen or a group —$OCH_2CH_2CH(R')CH_2CH_2OR$ (R is a linear or branched $C_nH_{2n+1}$, $1 \leq n \leq 20$, preferably $4 \leq n \leq 16$, more preferably $4 \leq n \leq 12$, particularly preferably $6 \leq n \leq 8$, and R' is methyl or ethyl).

In addition, in the formula (3), it is preferable that $R^{32}$ or $R^{33}$, and $R^{42}$ or $R^{43}$ is a group —$OCH_2CH_2CH(R')CH_2CH_2OR$ (R is a linear $C_nH_{2n+1}$, $1 \leq n \leq 15$, and R' is methyl).

The tricyclic liquid crystal compound represented by the formula (2) is preferably at least one kind among the compounds represented by the following formulae (4) to (6).

[Formula 37]
(4)
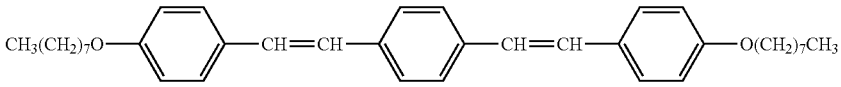
(5)
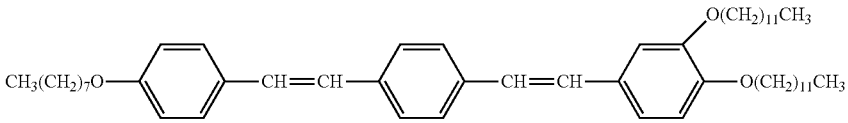
(6)
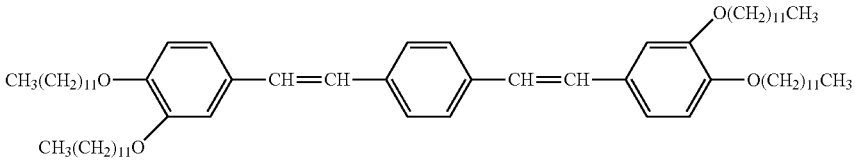
The tricyclic liquid crystal compound represented by the formula (3) is preferably at least one kind of the compounds represented by the following formulae (7) and (8).
[Formula 38]
(7)
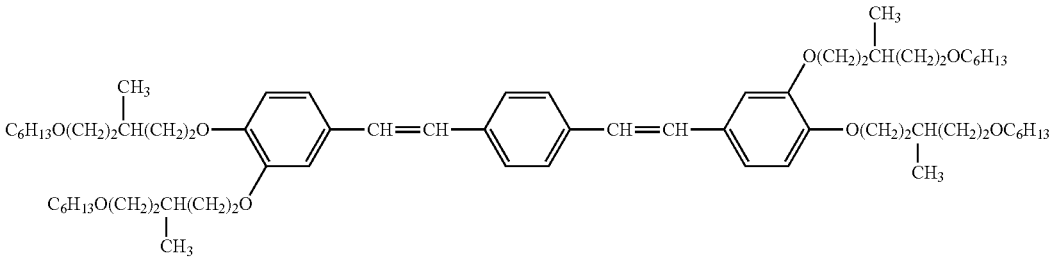
(8)
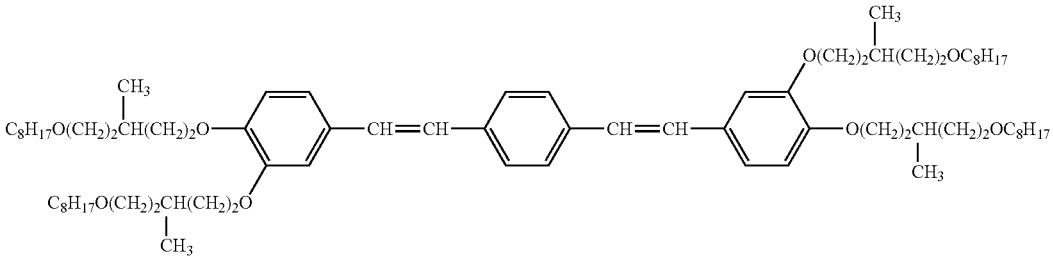
The bicyclic liquid crystal compound represented by the formula (1) is preferably at least one kind of the compounds represented by the following formulae (9) to (11).
[Formula 39]
(9)
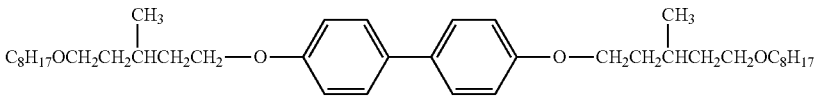
(10)
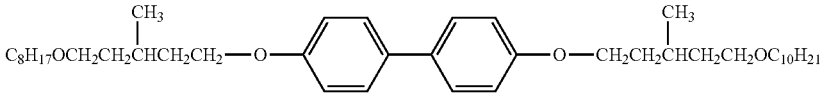

-continued (11)

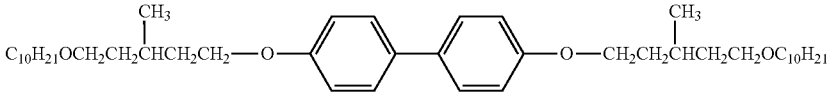

In the present invention, the tricyclic liquid crystal compound represented by the formula (2) may be used alone, or two or more kinds may be used in combination. For example, among the compounds represented by the above-mentioned formulae (4) to (6), any of these may be used alone, or two or more kinds may be used in combination. Also, all the compounds represented by the above-mentioned formulae (4) to (6) may be used in admixture.

In the present invention, the tricyclic liquid crystal compound represented by the formula (3) may be used alone, or two or more kinds may be used in combination. For example, any of the compounds represented by the above-mentioned formulae (7) and (8) may be used alone, and these may be used in admixture.

In the present invention, the bicyclic liquid crystal compound represented by the formula (1) may be used alone, or two or more kinds may be used in combination. For example, any of the compound represented by the above-mentioned formulae (9) to (11) may be used alone, or two or more kinds may be used in combination. Also, all the compound represented by the above-mentioned formulae (9) to (11) may be used in admixture.

Preparation methods of the bicyclic liquid crystal compound represented by the formula (1), and the tricyclic liquid crystal compound represented by the formula (2) are not particularly limited, and these can be prepared by combining the known reactions.

For example, these can be prepared in accordance with the method described in JP 2017-105874A.

A preparation method of the tricyclic liquid crystal compound represented by the formula (3) is not particularly limited, and it can be prepared by combining the known reactions. An example of the preparation method of the tricyclic liquid crystal compound represented by the formula (3) is shown as follows.

It can be prepared by a method using an alcohol compound (for example, $R^{31}$—OH) or a phenol compound (for example, HO-[3-ring skeletal structure]-OH) and an alkali metal or an alkali metal alcoholate, and reacting with a halogen compound (for example, $R^{31}$—X or X-[3-ring skeletal structure]-X (X is a halogen atom such as a chlorine atom, a bromine atom, an iodine atom and the like)). For example, it can be prepared in accordance with the method described in JP Patent No. 5,916,916.

In particular, the tricyclic liquid crystal compound represented by the formula (3) can be prepared as follows.

At least one kind of the compound represented by the formula:

[Formula 40]

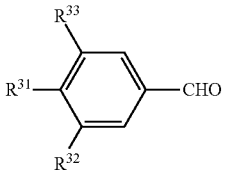

[wherein, $R^{31}$ is a group —$OCH_2CH_2CH(R')CH_2CH_2OR$ (R is a linear or branched $C_nH_{2n+1}$, $1 \leq n \leq 20$, and R' is methyl or ethyl), $R^{32}$ and $R^{33}$ are the same or different from each other, and each is hydrogen or a group —$OCH_2CH_2CH(R')CH_2CH_2OR$ (R is a linear or branched $C_nH_{2n+1}$, $1 \leq n \leq 20$, and R' is methyl or ethyl)], at least one kind of the compound represented by the formula:

[Formula 41]

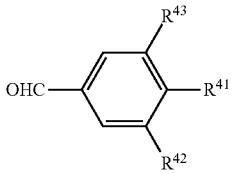

[wherein, $R^{41}$ is a group —$OCH_2CH_2CH(R')CH_2CH_2OR$ (R is a linear or branched $C_nH_{2n+1}$, $1 \leq n \leq 20$, and R' is methyl or ethyl), $R^{42}$ and $R^{43}$ are the same or different from each other, and each is hydrogen or a group —$OCH_2CH_2CH(R')CH_2CH_2OR$ (R is a linear or branched $C_nH_{2n+1}$, $1 \leq n \leq 20$, and R' is methyl or ethyl)], and the compound represented by the formula:

[Formula 42]

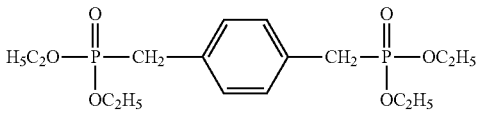

are reacted under appropriate reaction conditions to obtain a mixture of the following compounds

[Formula 43]

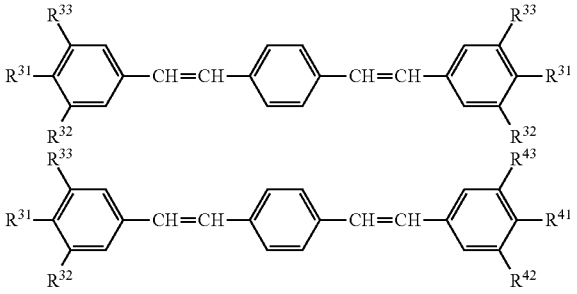

-continued

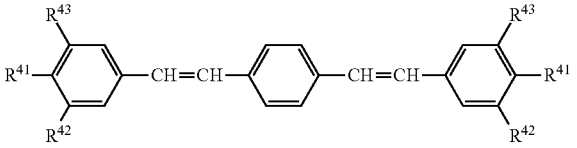

[wherein, $R^{31}$, $R^{32}$, $R^{33}$, $R^{41}$, $R^{42}$ and $R^{43}$ are as defined above] with a molar ratio of 1:2:1.

Incidentally, examples of the above-mentioned alkali metal are potassium carbonate, potassium hydroxide, sodium hydroxide and the like. Also, examples of the above-mentioned alkali metal alcoholate are sodium ethylate, sodium methylate, sodium tert-butoxide, potassium tert-butoxide and the like.

Also, in the above-mentioned reaction, conventionally known various kinds of organic solvents can be used and, for example, diethyl ether, tetrahydrofuran (THF), acetone and toluene can be used.

It can be prepared by another method as follows.

At least one kind of the compound represented by the formula:

[Formula 44]

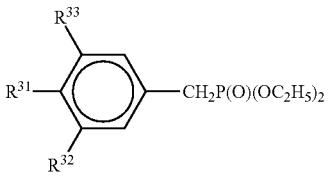

[wherein, $R^{31}$ is a group —$OCH_2CH_2CH(R')CH_2CH_2OR$ (R is a linear or branched $C_nH_{2n+1}$, $1 \leq n \leq 20$, and R' is methyl or ethyl), $R^{32}$ and $R^{33}$ are the same or different from each other, and each is hydrogen or a group —$OCH_2CH_2CH(R')CH_2CH_2OR$ (R is a linear or branched $C_nH_{2n+1}$, $1 \leq n \leq 20$, and R' is methyl or ethyl)]

at least one kind of the compound represented by the formula:

[Formula 45]

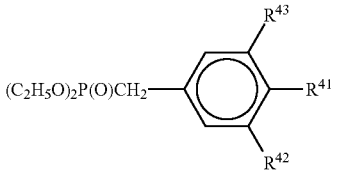

[wherein, $R^{41}$ is a group —$OCH_2CH_2CH(R')CH_2CH_2OR$ (R is a linear or branched $C_nH_{2n+1}$, $1 \leq n \leq 20$, and R' is methyl or ethyl), $R^{42}$ and $R^{43}$ are the same or different from each other, and each is hydrogen or a group —$OCH_2CH_2CH(R')CH_2CH_2OR$ (R is a linear or branched $C_nH_{2n+1}$, $1 \leq n \leq 20$, and R' is methyl or ethyl)], and terephthalaldehyde represented by the formula:

[Formula 46]

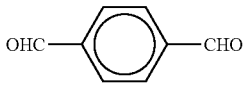

are reacted under appropriate reaction conditions to obtain a mixture of the following compounds

[Formula 47]

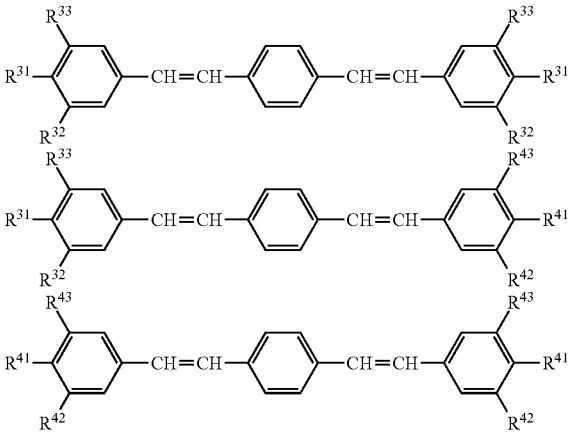

[wherein, $R^{31}$, $R^{32}$, $R^{33}$, $R^{41}$, $R^{42}$ and $R^{43}$ are as defined above] with a molar ratio of 1:2:1.

The lubricant composition according to the present invention is extremely difficult to evaporate (for example, the remaining ratio in an atmosphere at a temperature of 100° C. after lapse of 600 hours is 95% or more), so that it has the advantage that it can be used continuously without replenishing for a long period of time as compared with general purpose grease and the like.

The lubricant composition according to the present invention is extremely difficult to evaporate under high vacuum (for example, the remaining ratio in an atmosphere at a temperature of 25° C. and a pressure of $10^{-5}$ Pa after lapse of 1,000 hours is 95% or more), so that it can be suitably used under high vacuum such as in outer space and the like.

The lubricant composition according to the present invention has extremely low dusting characteristics, so that it can be suitably used, for example, in a semiconductor manufacturing apparatus installed in a clean room where high cleanliness is required.

The lubricant composition according to the present invention is difficult to evaporate and has low dusting characteristics. Also, the lubricant composition according to the present invention can stably exhibit its performance under high vacuum or high temperature. Therefore, the lubricant composition according to the present invention can exhibit excellent performance as a lubricant for bearings.

The bearing in which the lubricant composition according to the present invention is sealed can be suitably used, for example, in a semiconductor manufacturing apparatus installed in a clean room. Also, the bearing in which the lubricant composition according to the present invention is sealed can be suitably used for a machine or an apparatus installed under a high vacuum such as outer space and the like. Further, the bearing in which the lubricant composition according to the present invention is sealed can be suitably used for precision machinery, wind power generators that are difficult in maintenance, seismic isolation devices, and the like.

Further, specific examples of the bearing in which the lubricant composition according to the present invention is sealed are bearings used in automobile electrical components such as electric fan motors and wiper motors, rolling bearings used in automobile engine accessories such as water pumps, electromagnetic clutch devices and the like and drive systems, rolling bearings used in rotating devices such as small to large general-purpose motors for industrial mechanical apparatuses, high-speed and high-precision rolling bearings such as spindle bearings for machine tools, rolling bearings used in motors and rotating devices for household appliances such as air conditioner fan motors and washing machines, rolling bearings used for rotating parts of computer-related equipment such as HDD devices, DVD devices and the like, rolling bearings used for rotating parts of office machines such as copying machines, automatic ticket gates and the like, and axial bearings of electric trains and freight cars.

Other components that the lubricant composition of the present invention may contain as long as the effects of the present invention are not impaired will be explained in order. These are basically conventionally known substances as components contained in the lubricant, and the contents thereof can be appropriately selected by those skilled in the art within the range of conventionally known unless otherwise specifically mentioned. Also, any of the components may be used alone or in combination of two or more kinds.

(Liquid Crystal Compound)

The compounds represented by the formulae (1) to (3) are liquid crystal compounds, but the lubricant composition of the present invention may contain liquid crystal compound (s) other than these.

Examples of such a liquid crystal compound are a liquid crystal compound showing a smectic phase or a nematic phase, an alkylsulfonic acid, a compound having a Nafion film-based structure, an alkylcarboxylic acid, an alkylsulfonic acid, and the like. In addition, the lubricant composition of the present invention may contain the liquid crystal compound(s) described in JP Patent No. 5,916,916 or JP 2017-105874A.

(Base Oil)

The lubricant composition of the present invention and the conventionally known various kinds of lubricant base oils may be mixed and used.

Examples of the above-mentioned base oil is not particularly limited and are mineral oil, highly refined mineral oil, synthetic hydrocarbon oil, paraffinic mineral oil, alkyl diphenyl ether oil, ester oil, silicone oil, naphthenic mineral oil, fluorine oil and the like.

(Other Additives)

Other additives which can be added to the lubricant composition of the present invention are various kinds of additives that are used for lubricants such as bearing oil, gear oil, hydraulic oil, and the like, that is, extreme pressure agents, orientation adsorbents, wear preventing agents, wear adjusting agents, oily agents, antioxidants, viscosity index improvers, pour point depressants, detergent dispersants, metal inactivators, corrosion inhibitors, rust preventive agents, defoaming agents, solid lubricants, and the like.

Examples of the above-mentioned extreme pressure agents are chlorine-based compounds, sulfur-based compounds, phosphoric acid-based compounds, hydroxycarboxylic acid derivatives and organic metal-based extreme pressure agents. By adding the extreme pressure agent, wear resistance of the electrically-conductive lubricant of the present invention is improved.

Examples of the above-mentioned orientation adsorbents are organic silane, organic titanium, organic aluminum and the like represented by various kinds of coupling agents such as silane coupling agents, titanium coupling agents, aluminum coupling agents and the like. By adding the orientation adsorbent, liquid crystal orientation of the liquid crystal compound contained in the lubricant composition of the present invention is strengthened, and the thickness and strength of the coating film formed from the lubricant composition of the present invention can be strengthened.

The lubricant composition of the present invention can be prepared by mixing the compounds represented by the formulae (1) to (3) and other components explained above by a conventionally known method. An example of the method for preparing the lubricant composition of the present invention is shown as follows.

The constitutional components of the lubricant composition are mixed by a conventional method, and thereafter, if necessary, roll milling, defoaming treatment, filter treatment, and the like, are carried out to obtain the lubricant composition of the present invention. Or else, the oil component of the lubricant composition may be previously mixed, subsequently other components such as additives, and the like, are added and mixed, and if necessary, the above-mentioned defoaming treatment, and the like, is carried out to also prepare the lubricant composition.

Examples

Hereinafter, more specific Examples of the present invention are explained, but the present invention is not limited to these.

[Preparation of Lubricant Composition]

As the bicyclic liquid crystal compound represented by the formula (1), a mixture of the compounds represented by the following formulae (9) to (11) was prepared. The mixing ratio of the compounds represented by the formulae (9) to (11) is approximately 1:2:1 (molar ratio).

[Formula 48]

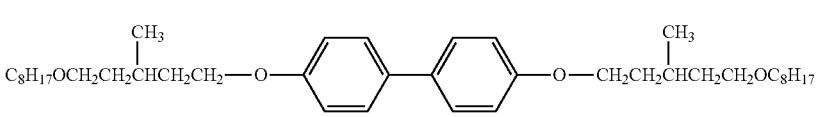

(9)

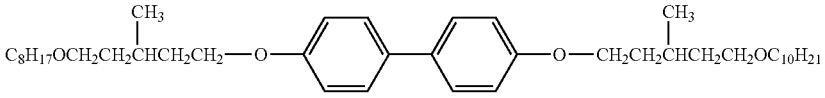

(10)

-continued (11)

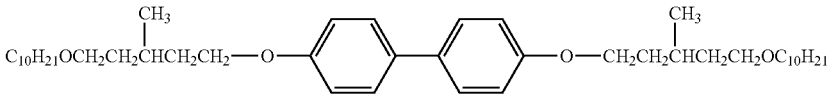

As the tricyclic liquid crystal compound represented by the formula (2), a mixture of the compounds represented by the following formulae (4) to (6) was prepared. The mixing ratio of the compounds represented by the formulae (4) to (6) is approximately 1:2:1 (molar ratio).

[Formula 49]

(4)

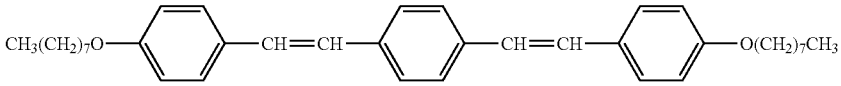

(5)

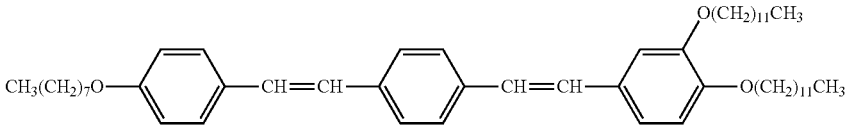

(6)

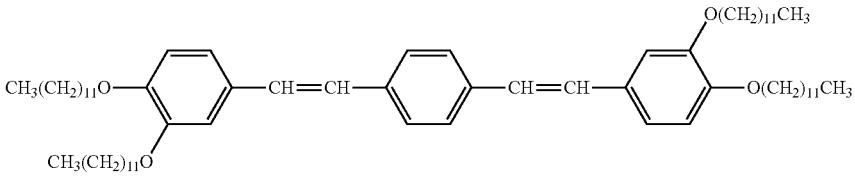

As the tricyclic liquid crystal compound represented by the formula (3), the compounds represented by the formulae (7) and (8) were prepared, respectively.

[Formula 50]

(7)

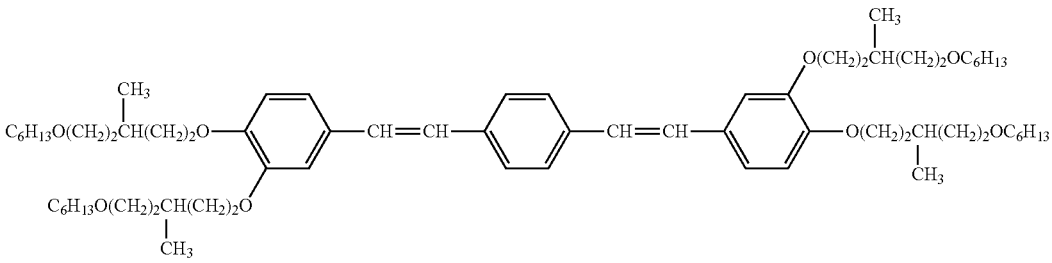

(8)

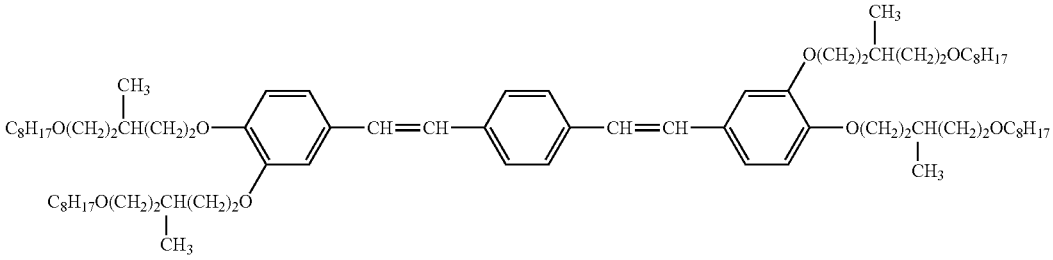

That is, the bicyclic liquid crystal compounds (a mixture of the compounds represented by the formulae (9) to (11)), and three kinds of the tricyclic liquid crystal compounds were prepared. The three kinds of the tricyclic liquid crystal compounds will be referred to as follows in the following.

Tricyclic liquid crystal compound LC1: Mixture of the compounds represented by the formulae (4) to (6)

Tricyclic liquid crystal compound LC2: Compound represented by the formula (7)

Tricyclic liquid crystal compound LC3: Compound represented by the formula (8)

The bicyclic liquid crystal compound and the tricyclic liquid crystal compounds LC1 to LC3 prepared as mentioned above were heated to 200° C. and mixing them with various ratios to prepare the lubricant compositions (Sample Nos. 1 to 23) shown in the following Table 1. The numerals in the table indicate mass %.

TABLE 1

| Sample No. | Bicyclic liquid crystal compound | Tricyclic liquid crystal compound LC1 | Tricyclic liquid crystal compound LC2 | Tricyclic liquid crystal compound LC3 | Results of softness test at normal temperature |
|---|---|---|---|---|---|
| 1 | 60 | 40 | 0 | 0 | B |
| 2 | 60 | 26.5 | 0 | 13.5 | A |
| 3 | 60 | 20 | 0 | 20 | A |
| 4 | 60 | 13.5 | 0 | 26.5 | A |
| 5 | 40 | 60 | 0 | 0 | B |
| 6 | 40 | 40 | 0 | 20 | A |
| 7 | 40 | 30 | 0 | 30 | A |
| 8 | 40 | 20 | 0 | 40 | A |
| 9 | 25 | 75 | 0 | 0 | B |
| 10 | 25 | 50 | 0 | 25 | B |
| 11 | 25 | 37.5 | 0 | 37.5 | B |
| 12 | 25 | 25 | 0 | 50 | B |
| 13 | 10 | 90 | 0 | 0 | C |
| 14 | 10 | 60 | 0 | 30 | B |
| 15 | 10 | 45 | 0 | 45 | B |
| 16 | 10 | 30 | 0 | 60 | B |
| 17 | 4 | 96 | 0 | 0 | C |
| 18 | 4 | 64 | 0 | 32 | B |
| 19 | 4 | 48 | 0 | 48 | B |
| 20 | 4 | 32 | 0 | 64 | B |
| 21 | 25 | 25 | 50 | 0 | B |
| 22 | 20 | 0 | 80 | 0 | A |
| 23 | 20 | 0 | 0 | 80 | A |

Using the prepared lubricant composition, the following multiple kinds of tests were carried out.

[Softness Test at Normal Temperature]

After cooling the lubricant composition to normal temperature (25° C.), it was stirred with a spatula several times and the test of sealing in a bearing was carried out. For the test, ball spline bearings were used.

Figure 10:
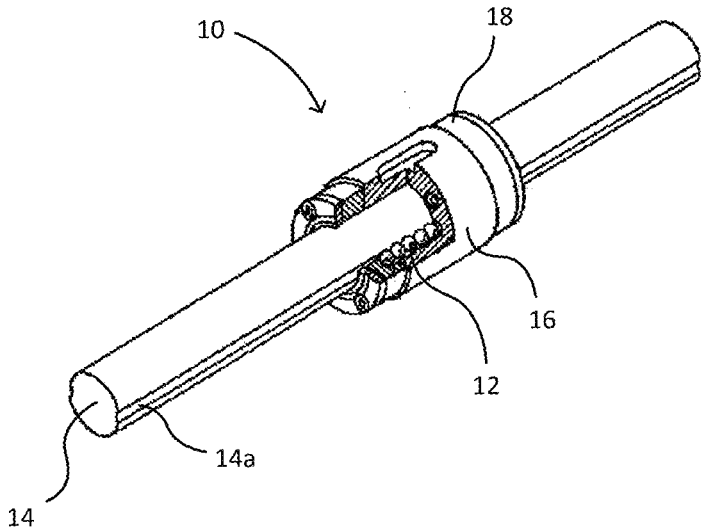
FIG. 10 is a perspective view of a bearing.

The ball spline bearing is, for example, as shown in FIG. 10, a small ball spline bearing 10 having an outer cylinder 16 that can move linearly along a shaft 14 through a plurality of rolling elements 12. On the outer peripheral surface of the shaft 14, a raceway groove 14*a* on which a plurality of rolling elements 12 being rolled is formed along the axial direction. The plurality of rolling elements 12 are held between the raceway grooves 14*a* formed on the outer peripheral surface of the shaft 14 and the inner surface of the outer cylinder 16. At the end portion of the outer cylinder 16, an end cap 18 for changing the direction of the plurality of rolling elements 12 is fixed by screwing or the like. The plurality of rolling elements 12 being rolled along the raceway grooves 14*a* are so configured that they are infinitely circulated by changing their direction in a direction-changing path formed in the end cap 18.

When the lubricant composition was sealed in the bearing 10, after the shaft 14 was pulled out from the outer cylinder 16, the lubricant composition was coated onto a plurality of rolling elements 12 held inside the outer cylinder 16. After coating the lubricant composition onto the plurality of rolling elements 12, as shown in FIG. 10, the outer cylinder 16 was assembled again on the shaft 14.

Then, the lubricant composition was sealed in the bearing 10, the softness of the lubricant composition at normal temperature was judged based on whether the rolling element could circulate or not. The judgment criteria are as follows. Incidentally, for the test, a small ball spline bearing ("LSAG4" manufactured by Nippon Thompson Co., Ltd.) having a diameter of the shaft of 4 mm was used.

A: The rolling elements are possible to circulate, and the lubricant composition remarkably has flexibility.

B: The rolling elements are possible to circulate, and the lubricant composition has flexibility.

C: The rolling elements are impossible to circulate, the lubricant composition has no flexibility and easily crushable.

In the above Table 1, the results of the softness test of the lubricant composition at normal temperature are shown.

From the results shown in Table 1, the lubricant composition of the present invention (Samples Nos. 2, 3, 4, 6, 7, 8, 10, 11, 12, 14, 15, 16, 18, 19, 20, 21) containing the bicyclic liquid crystal compound, the tricyclic liquid crystal compound LC1 and at least one of the tricyclic liquid crystal compounds LC2 and LC3 have moderate flexibility, and when it was sealed in a bearing, the rolling element was in the state of capable of circulating.

In particular, when the mixing ratio of the bicyclic liquid crystal compound and the sum of the tricyclic liquid crystal compounds LC1 to LC3 is 60:40 to 4:96 in terms of mass ratio (Sample Nos. 2, 3, 4, 6, 7, 8, 10, 11, 12, 14, 15, 16, 18, 19, 20, 21), the lubricant compositions had sufficient softness, and it was easy to seal the lubricant composition into the bearing.

[Fluidity Test at the Time of Heating]

Figure 11:
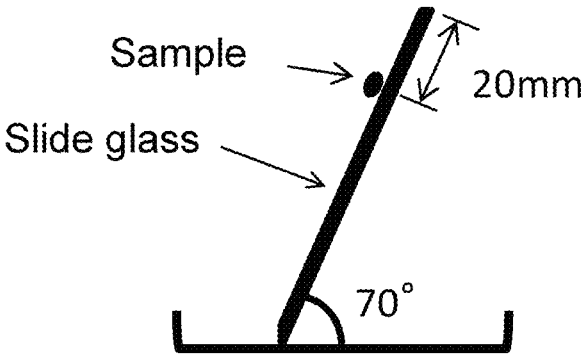
FIG. 11 is a schematic view of an apparatus used for the fluidity test.

A test for confirming fluidity of the lubricant composition at the time of heating was carried out. The device used for the test is shown in FIG. 11.

In the test, first, the lubricant composition (about 5 mg) was adhered on the slide glass. The inclination angle of the slide glass was set to 70°. The lubricant composition was attached at a position 20 mm from the upper end of the slide glass. After adhering the lubricant composition onto the slide glass, the slide glass was heated in an oven until it reached a predetermined temperature. After leaving the heated slide glass for 10 minutes, the fluidity of the lubricant composition was judged by visually observing the lubricant composition adhered onto the slide glass. The judgment criteria are as follows.

○: The lubricant composition does not drip on the slide glass.

x: The lubricant composition is dripping on the slide glass.

In the following Table 2, the results of the fluidity test of the lubricant composition at the time of heating were shown. Sample No. in Table 2 correspond to Sample No. in Table 1.

TABLE 2

| Heating temperature | Sample No. | | | | | | | | | | | | | | | | | | | | | | |
|---|---|---|---|---|---|---|---|---|---|---|---|---|---|---|---|---|---|---|---|---|---|---|---|
| (° C.) | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
| 25 | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| 30 | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| 40 | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| 50 | ○ | ○ | ○ | ○ | ○ | ○ | ○ | ○ | ○ | ○ | ○ | ○ | ○ | ○ | ○ | ○ | ○ | ○ | ○ | ○ | ○ | X | X |
| 55 | ○ | ○ | ○ | ○ | ○ | ○ | ○ | ○ | ○ | ○ | ○ | ○ | ○ | ○ | ○ | ○ | ○ | ○ | ○ | ○ | ○ | X | X |
| 60 | ○ | ○ | ○ | ○ | ○ | ○ | ○ | ○ | ○ | ○ | ○ | ○ | ○ | ○ | ○ | ○ | ○ | ○ | ○ | ○ | ○ | X | X |
| 80 | ○ | ○ | ○ | ○ | ○ | ○ | ○ | ○ | ○ | ○ | ○ | ○ | ○ | ○ | ○ | ○ | ○ | ○ | ○ | ○ | ○ | X | X |
| 90 | ○ | ○ | ○ | ○ | ○ | ○ | ○ | ○ | ○ | ○ | ○ | ○ | ○ | ○ | ○ | ○ | ○ | ○ | ○ | ○ | ○ | X | X |
| 100 | ○ | ○ | ○ | ○ | ○ | ○ | ○ | ○ | ○ | ○ | ○ | ○ | ○ | ○ | ○ | ○ | ○ | ○ | ○ | ○ | ○ | X | X |
| 110 | ○ | ○ | X | X | ○ | ○ | ○ | ○ | ○ | ○ | ○ | ○ | ○ | ○ | ○ | ○ | ○ | ○ | ○ | ○ | ○ | X | X |
| 115 | ○ | X | X | X | ○ | ○ | X | X | ○ | ○ | ○ | ○ | ○ | ○ | ○ | ○ | ○ | ○ | ○ | ○ | ○ | X | X |
| 120 | ○ | X | X | X | ○ | ○ | X | X | ○ | ○ | ○ | X | ○ | ○ | ○ | ○ | ○ | ○ | ○ | ○ | X | X | X |
| 125 | ○ | X | X | X | ○ | X | X | X | ○ | ○ | X | X | ○ | ○ | ○ | X | ○ | ○ | ○ | ○ | X | X | X |
| 130 | X | X | X | X | ○ | X | X | X | ○ | ○ | X | X | ○ | ○ | ○ | X | ○ | ○ | ○ | X | X | X | X |
| 135 | X | X | X | X | ○ | X | X | X | ○ | X | X | X | ○ | ○ | X | X | ○ | ○ | ○ | X | X | X | X |
| 140 | X | X | X | X | ○ | X | X | X | ○ | X | X | X | ○ | ○ | X | X | ○ | ○ | X | X | X | X | X |
| 145 | X | X | X | X | X | X | X | X | ○ | X | X | X | ○ | X | X | X | ○ | ○ | X | X | X | X | X |
| 150 | X | X | X | X | X | X | X | X | ○ | X | X | X | ○ | X | X | X | ○ | X | X | X | X | X | X |
| 155 | X | X | X | X | X | X | X | X | X | X | X | X | ○ | X | X | X | ○ | X | X | X | X | X | X |
| 160 | X | X | X | X | X | X | X | X | X | X | X | X | X | X | X | X | ○ | X | X | X | X | X | X |
| 165 | X | X | X | X | X | X | X | X | X | X | X | X | X | X | X | X | X | X | X | X | X | X | X |
| 170 | X | X | X | X | X | X | X | X | X | X | X | X | X | X | X | X | X | X | X | X | X | X | X |
| 175 | X | X | X | X | X | X | X | X | X | X | X | X | X | X | X | X | X | X | X | X | X | X | X |
| 180 | X | X | X | X | X | X | X | X | X | X | X | X | X | X | X | X | X | X | X | X | X | X | X |
| 185 | X | X | X | X | X | X | X | X | X | X | X | X | X | X | X | X | X | X | X | X | X | X | X |
| 190 | X | X | X | X | X | X | X | X | X | X | X | X | X | X | X | X | X | X | X | X | X | X | X |
| 195 | X | X | X | X | X | X | X | X | X | X | X | X | X | X | X | X | X | X | X | X | X | X | X |
| 200 | X | X | X | X | X | X | X | X | X | X | X | X | X | X | X | X | X | X | X | X | X | X | X |

From the results shown in Table 2, in the lubricant compositions of the present invention, it was found that when the content of the bicyclic liquid crystal compound exceeds 45 wt % (Samples Nos. 2, 3 and 4), they melted (liquefied) when heated to 115° C. and hung down. Accordingly, for example, in order to obtain a lubricant composition in which dripping does not occur even at a high temperature (about 100° C.) during baking of a vacuum apparatus, it was found that the content of the bicyclic liquid crystal compound contained in the lubricant composition is preferably 4 to 40 wt %.

From the above-mentioned test results, in order to obtain a lubricant composition that could be sealed in a bearing at normal temperature and does not drip from the bearing even at, for example, a high temperature of 100° C., it was found that the content of the bicyclic liquid crystal compound was 4 to 40 wt %, and the content of the tricyclic liquid crystal compounds LC2 and LC3 were preferably 20 to 64 wt %.

[Durability Test Under High Temperature]

A lubricant composition was prepared by mixing the bicyclic liquid crystal compound and the tricyclic liquid crystal compounds LC1 to LC3 prepared as mentioned above with a mass ratio shown in the following Table 3. The prepared lubricant composition was sealed in a bearing 10 shown in FIG. 10, and a test was carried out in which the shaft 14 was continuously reciprocated while the outer cylinder 16 is in the state of fixed while being heated. When the vibration value of the bearing 10 under the test exceeded the set value, or at the time of confirming abnormal occurrence of wear powder, the test was stopped and the mileage at that time was measured. Other test conditions are as follows. Also, as Comparative Example, a commercially available cyclopentane-based lubricant for vacuum and a fluorine-based lubricant for vacuum were each sealed in the bearing, and the same test was carried out. The results of these tests are shown in the following Table 3.

(Test Conditions)

Heating temperature of outer cylinder: 80° C.

Load: Medium precompression

Stroke: 50 mm

Maximum speed: 1 m/s

Sealed amount of lubricant composition: 3 mg

TABLE 3

| Bicyclic liquid crystal compound | Tricyclic liquid crystal compound LC1 | Tricyclic liquid crystal compound LC2 | Tricyclic liquid crystal compound LC3 | Mileage (km) |
|---|---|---|---|---|
| 60 | 40 | 0 | 0 | 251 |
| 25 | 25 | 25 | 25 | 214 |
| 10 | 30 | 30 | 30 | 162 |
| Cyclopentane-based lubricant for vacuum | | | | 220 |
| Fluorine-based lubricant for vacuum | | | | 147 |

From the results shown in Table 3, it was confirmed that the lubricant composition of the present invention containing the bicyclic liquid crystal compound and the tricyclic liquid crystal compounds LC1 to LC3 has sufficient durability under high temperature as a lubricant for bearing.

[Pressure Measurement Test at the Time of Temperature Raising]

A lubricant composition (1) in which a mixing ratio of the bicyclic liquid crystal compound and the tricyclic liquid crystal compound LC1 was 60:40 in a mass ratio was prepared. Also, a lubricant composition (2) in which a mixing ratio of the bicyclic liquid crystal compound, the tricyclic liquid crystal compound LC1, the tricyclic liquid crystal compound LC2, and the tricyclic liquid crystal compound LC3 was 1:1:1:1 in a mass ratio was prepared. The pressure change (total pressure) when the prepared lubricant composition was heated was measured using a saturated vapor pressure evaluation device (VPE-9000 manufactured by ULVAC Inc.). The measurement conditions are as follows.

(Measurement Conditions)

Measurement temperature: room temperature to 200° C.

Temperature raising speed: 10° C./min

Pressure at the time of staring measurement: about $1.0\times10^{-5}$ Pa

Also, as Comparative Example, the same measurement was carried out using a commercially available cyclopentane-based lubricant for vacuum and a fluorine-based lubricant for vacuum. These measurement results are shown in FIG. 12.

Figure 12:
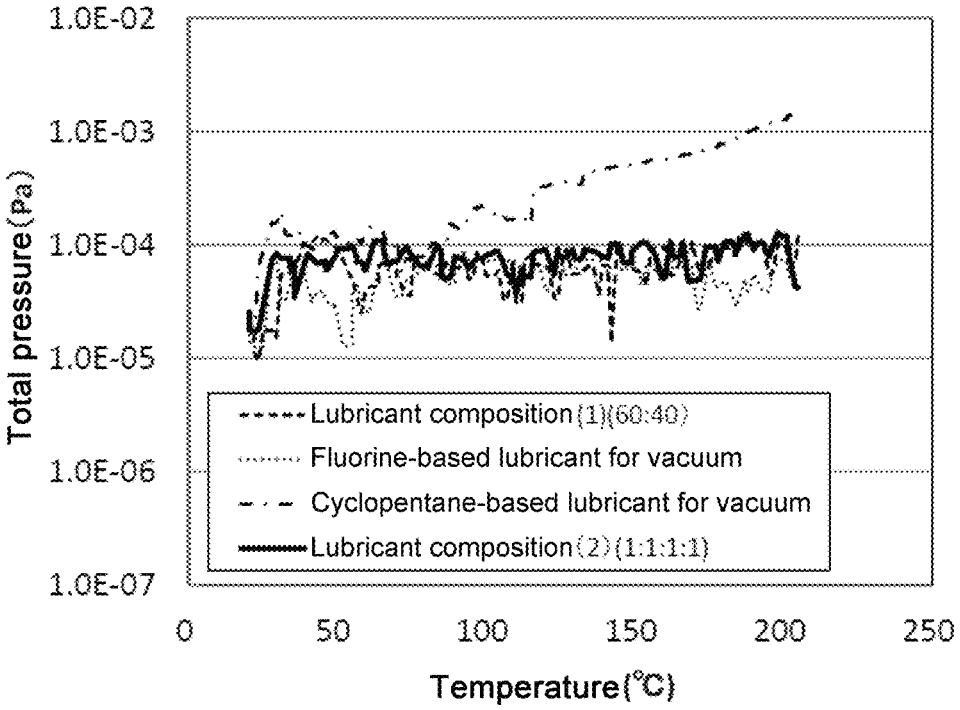
FIG. 12 is a graph showing the results of the pressure measurement test at the time of raising the temperature.

As shown in FIG. 12, the total pressure of the lubricant composition (2) of the present invention did not almost change up to around 200° C. To the contrary, it could be confirmed that the total pressure of the cyclopentane-based lubricant for vacuum rapidly rose at about 90° C. and easily evaporated. From these results, it could be confirmed that the lubricant composition of the present invention was extremely resistant to evaporation as compared with a commercially available cyclopentane-based lubricant for vacuum, and the total pressure was stable at room temperature to 200° C.

[Dusting Characteristics Test]

A test for evaluating dusting characteristics of the lubricant composition was carried out by continuously operating a linear motion guide unit in which the lubricant composition has been sealed. The linear motion guide unit used in the test is shown in FIG. 13.

Figure 13:
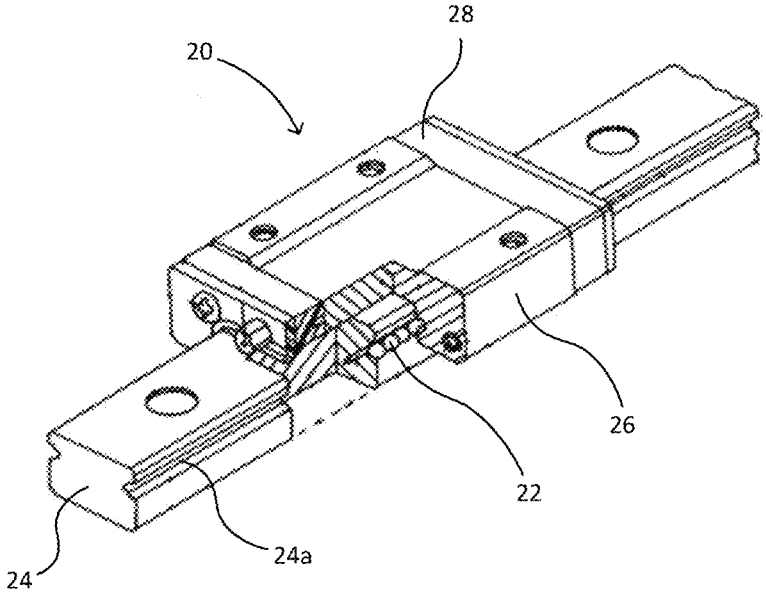
FIG. 13 is a perspective view of a linear motion guide unit.

As shown in FIG. 13, a linear motion guide unit 20 is a small linear motion guide unit ("LWL9" manufactured by Nippon Thompson Co., Ltd.) having a slider 26 that can move linearly along a track rail 24 through a plurality of rolling elements 22. On both side surfaces of the track rail 24, raceway grooves 24*a* on which a plurality of rolling elements 22 being rolled is formed along the longitudinal direction. The plurality of rolling elements 22 are held between the raceway grooves 24*a* formed on both side surfaces of the track rail 24 and the inner surface of the slider 26. At the end portion of the slider 26, an end cap 28 for changing the direction of the plurality of rolling elements 22 is fixed by screwing or the like. The plurality of rolling elements 22 being rolled along the raceway grooves 24*a* are so configured that they are infinitely circulated by changing their direction in a direction-changing path formed in the end cap 28.

In the test, first, the following three kinds of lubricant compositions were prepared.

Lubricant composition (1): Lubricant composition in which the mixing ratio of the bicyclic liquid crystal compound and the tricyclic liquid crystal compound LC1 is 60:40 in a mass ratio Lubricant composition (2): Lubricant composition in which the mixing ratio of the bicyclic liquid crystal compound, the tricyclic liquid crystal compound LC1, the tricyclic liquid crystal compound LC2, and the tricyclic liquid crystal compound LC3 is 1:1:1:1 in a mass ratio Lubricant composition (3): Lubricant composition in which the mixing ratio of the bicyclic liquid crystal compound and the tricyclic liquid crystal compound LC1 is 80:20 in a mass ratio The prepared lubricant compositions were each sealed in the linear motion guide unit 20. When the lubricant composition was sealed in the linear motion guide unit 20, the track rail 24 was pulled out from the slider 26, and then, the lubricant composition was coated onto a plurality of rolling elements 22 held inside the slider 26. After coating the lubricant composition onto the plurality of rolling elements 22, as shown in FIG. 13, the slider 26 was reassembled on the track rail 24.

Next, the linear motion guide unit 20 in which the lubricant composition has been sealed was continuously reciprocated in the chamber. During operating the linear motion guide unit 20, clean air that has passed through a HEPA filter was sent into the chamber by a downflow method, and the number of particles in the exhaust gas discharged from the chamber was measured by each particle diameter range shown in the following Table 4. For the measurement of the number of particles, a particle counter (KC-22A, manufactured by Rion Co., Ltd.) was used. Other measurement conditions are as follows.

(Measurement Conditions)

Moving distance of linear motion guide unit: 500 mm

Maximum speed: 1 m/s

Load: 80N

Air volume (sampling air volume): 0.38 $m^3$/min

Measurement time: 24 hours

Also, as Comparative Example, a commercially available cyclopentane-based lubricant for vacuum and a hydrocarbon-based lubricant for low-dusting were each sealed in the linear motion guide unit 20, and the same test was carried out. The results of these tests are shown in the following Table 4 and FIG. 14.

TABLE 4

| | Average dusting amount (particles/$m^3$) per each particle diameter (μm) range | | | | |
|---|---|---|---|---|---|
| | 0.10-0.15 | 0.15-0.20 | 0.20-0.30 | 0.30-0.50 | 0.5 or more |
| Lubricant compositions (1) (60:40) | 1965 | 1131 | 1354 | 2217 | 4827 |
| Lubricant compositions (2) (1:1:1:1) | 350 | 161 | 262 | 373 | 608 |
| Lubricant compositions (3) (80:20) | 25722 | 15590 | 20301 | 18783 | 79016 |
| Cyclopentane-based lubricant for vacuum | 3767 | 8904 | 10081 | 19297 | 88775 |
| Hydrocarbon-based lubricant for low-dusting | 1014 | 1450 | 1899 | 2315 | 3626 |

Figure 14:
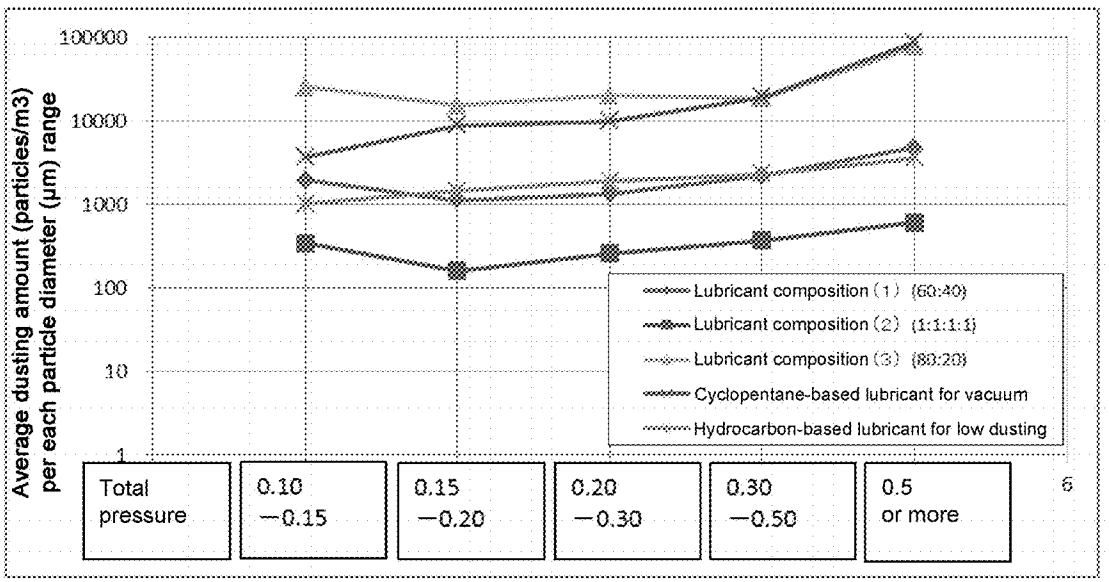
FIG. 14 is a graph showing the results of the dusting characteristics test.

From the results shown in Table 4 and FIG. 14, it could be confirmed that the dusting amount of the lubricant composition (2) of the present invention was extremely little as compared with the other lubricant compositions (1) and (3) and, for example, it had excellent properties as a lubricant for bearings used in a clean environment.

Also, it could be confirmed that the lubricant composition (2) of the present invention had sufficiently low dusting characteristics as compared with a commercially available cyclopentane-based lubricant for vacuum or a hydrocarbon-based lubricant for low-dusting.

EXPLANATION OF REFERENCE NUMERALS

10 Bearing
12 Rolling element
14 Axis
16 Outer cylinder
18 End cap
20 Linear motion guide unit
22 Rolling element
24 Track rail
26 Slider
28 End cap

The invention claimed is:

1. A lubricant composition which comprises a bicyclic liquid crystal component and a tricyclic liquid crystal component, wherein the bicyclic liquid crystal component consists essentially of at least one kind of a bicyclic liquid crystal compound represented by the following formula (1) and the tricyclic liquid crystal component consists essentially of at least one kind of a tricyclic liquid crystal compound represented by the following formula (2), and a mixing ratio of the above-mentioned bicyclic liquid crystal compound and the above-mentioned tricyclic liquid crystal compound is 95:5 to 15:85 in a mass ratio, wherein the above-mentioned bicyclic liquid crystal compound is present in a higher concentration than the above-mentioned tricyclic liquid crystal compound, Formula (1)

(1)

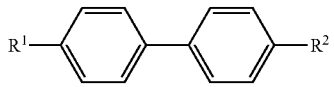

wherein, $R^1$ and $R^2$ are the same or different from each other, and each is a group —$OCH_2CH_2CH(R')CH_2CH_2OR$, wherein R is a linear or branched $C_nH_{2n+1}$, $1 \leq n \leq 20$, and R' is methyl or ethyl, Formula (2)

(2)

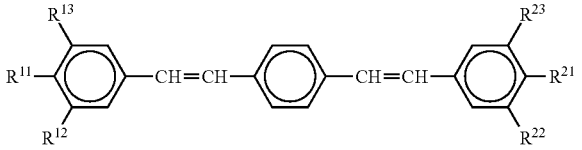

wherein, $R^{11}$ and $R^{21}$ are the same or different from each other, and each is a group —OR, wherein R is a linear or branched $C_nH_{2n+1}$, and $1 \leq n \leq 20$, and $R^{12}$, $R^{13}$, $R^{22}$ and $R^{23}$ are the same or different from each other, and each is hydrogen or a group —OR, wherein R is a linear or branched $C_nH_{2n+1}$, and $1 \leq n \leq 20$.

2. The lubricant composition according to claim 1, wherein, in the above formula (1), $1 \leq n \leq 15$, and R' is methyl.

3. The lubricant composition according to claim 1, wherein the tricyclic liquid crystal component consists essentially of at least one kind among the compounds represented by the following formulae (3) to (5).

(3)

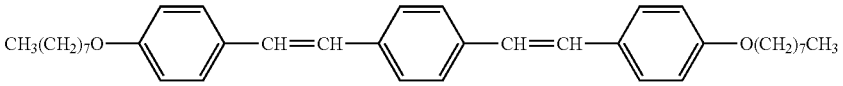

(4)

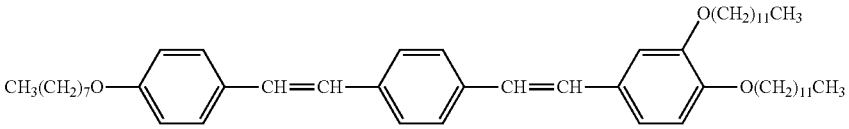

(5)

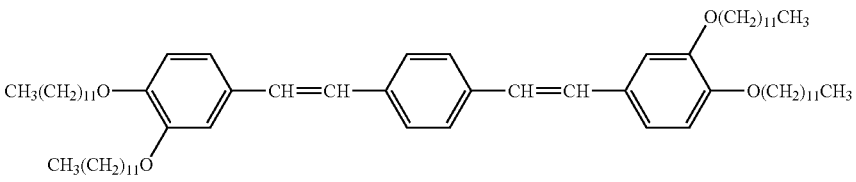

4. The lubricant composition according to claim 1, wherein a percent remaining of the lubricant composition, after holding in an atmosphere at a temperature of 100° C. and an atmospheric pressure for 600 hours, relative to an initial amount of the lubricant composition, is 95% or more.

5. The lubricant composition according to claim 1, wherein a percent remaining of the lubricant composition, after holding in an atmosphere at a temperature of 25° C. and a pressure of $10^{-5}$ Pa for 1,000 hours, relative to an initial amount of the lubricant composition, is 95% or more.

6. A bearing in which the lubricant composition according to claim 1 is sealed.

* * * * *